US012366430B2

(12) United States Patent
Mikroulis

(10) Patent No.: US 12,366,430 B2
(45) Date of Patent: Jul. 22, 2025

(54) FIREARM OPTICAL SIGHT, SYSTEM AND METHOD

(71) Applicant: Dimitri Mikroulis, Henderson, NV (US)

(72) Inventor: Dimitri Mikroulis, Henderson, NV (US)

( * ) Notice: Subject to any disclaimer, the term of this patent is extended or adjusted under 35 U.S.C. 154(b) by 33 days.

(21) Appl. No.: 18/399,196

(22) Filed: Dec. 28, 2023

(65) Prior Publication Data

US 2025/0020434 A1 Jan. 16, 2025

Related U.S. Application Data

(60) Division of application No. 29/766,756, filed on Jan. 18, 2021, now Pat. No. Des. 1,010,761, which is a continuation of application No. 17/122,692, filed on Dec. 15, 2020, now Pat. No. 11,150,052.

(60) Provisional application No. 62/958,044, filed on Jan. 7, 2020.

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS 7,296,358 B1 11/2007 Murphy et al.
7,522,356 B1 * 4/2009 Whitty ..... G02B 23/14 359/811
11,287,638 B2 * 3/2022 DeAngelis ..... F41G 1/345
2006/0010761 A1 1/2006 Staley, III
2009/0049733 A1 * 2/2009 Matthews ..... F41G 1/38 42/122
2013/0047485 A1 * 2/2013 Tubb ..... F41G 1/38 42/130
2013/0119257 A1 5/2013 Ikeda et al.
2013/0333266 A1 * 12/2013 Gose ..... G01J 1/0219 348/340
2014/0157646 A1 * 6/2014 McHale ..... F41A 17/08 42/119
2016/0290765 A1 * 10/2016 Maryfield ..... F41G 1/30
2017/0082400 A1 * 3/2017 York ..... F41G 1/44
2017/0138698 A1 * 5/2017 York ..... F41G 1/345
(Continued)

FOREIGN PATENT DOCUMENTS

EP 3540363 A1 * 9/2019 ..... F41G 1/30
WO WO 2018/011220 A1 1/2018

OTHER PUBLICATIONS

PCT Notification of Transmittal of the International Search Report and the Written Opinion of the International Searching Authority, or the Declaration; Mar. 12, 2021; International Application No. PCTUS20/65165; International Searching Authority, United States Patent and Trademark Office.

(Continued)

*Primary Examiner* — Samir Abdosh
(74) *Attorney, Agent, or Firm* — The Compton Law Firm, P.C.; Scott D. Compton

(57) ABSTRACT

The disclosure is directed to an optical sight for a firearm comprising a reticle operationally configured to visually inform a user when the optical sight is misaligned from an intended target and operationally configured to visually inform the user as to the direction of misalignment.

6 Claims, 23 Drawing Sheets

(56) References Cited

U.S. PATENT DOCUMENTS

| | | | | |
|---|---|---|---|---|
| 2019/0145735 | A1* | 5/2019 | Hancosky | F41G 1/545 42/119 |
| 2019/0257618 | A1 | 8/2019 | Mikroulis | |
| 2020/0081342 | A1* | 3/2020 | Baker | F41G 1/54 |
| 2020/0271419 | A1* | 8/2020 | Grace | F41G 1/545 |
| 2021/0207926 | A1* | 7/2021 | Mikroulis | F41G 1/30 |
| 2021/0278173 | A1* | 9/2021 | Mikroulis | F41G 1/473 |
| 2022/0034629 | A1* | 2/2022 | Hamilton | F41G 1/30 |

OTHER PUBLICATIONS

Mikroulis, Claims 1-18 of the International Application No. PCTUS20/65165; Dec. 15, 2020.

PCT International Preliminary Report on Patentability; Jul. 12, 2022; International Application No. PCT/US2020/065165; The International Bureau of WIPO, Geneva, Switzerland.

European Patent Office, Extended European Search Report, Application No. EP20912887.5, Dec. 21, 2023, Munich, Germany.

Mikroulis, Claims 1-12 of European Patent Application No. EP20912887.5; Sep. 12, 2022.

* cited by examiner

FIREARM OPTICAL SIGHT, SYSTEM AND METHOD

CROSS-REFERENCE TO RELATED APPLICATIONS

This application is a divisional of U.S. patent application Ser. No. 29/766,756, filed on Jan. 18, 2021, which is a continuation of U.S. patent application Ser. No. 17/122,692, filed on Dec. 15, 2020, which is entitled to the benefit of prior-filed U.S. Provisional Patent Application No. 62/958,044, filed on Jan. 7, 2020, the content of which are hereby incorporated by reference in their entirety.

STATEMENT REGARDING FEDERALLY SPONSORED RESEARCH OR DEVELOPMENT

Not applicable.

BACKGROUND OF THE DISCLOSURE

1. Field of the Disclosure

The present disclosure relates generally to an optical sight for firearms.

2. Background Art

Military and law enforcement type combat shooters often use semi-automatic firearms such as pistols and rifles equipped with non-magnifying electronic sights for close quarter combat type scenarios. Unlike shooting a firearm at a firing range where a shooter can maintain a stable shooting position, in close quarter combat type scenarios combat shooters are often required to shoot at fast emerging enemy combatants while moving and shoot around barricades in unorthodox shooting positions including shooting with the firearm canted to its side. In such instances, the reticle of the electronic sight may be lost from view when a combat shooter presents the firearm at an intended target. In other words, the reticle may not be in a shooter's field of view when presenting the firearm at an intended target. Additional time is then required to properly aim the firearm at an intended target by visually trying to place the reticle in the field of view. Moreover, low light or dark conditions may exacerbate correction of a misaligned electronic sight as an intended target and/or the electronic sight may be difficult to see in such conditions.

Overcoming the above shortcomings is desired.

SUMMARY OF THE DISCLOSURE

The present disclosure is directed to an optical sight for a firearm comprising a reticle including one or more aiming marks and one or more non-aiming marks; wherein at an operable eye distance of the optical sight, when the one or more aiming marks are in a field of view of the optical sight the one or more non-aiming marks are outside the field of view of the optical sight.

The present disclosure is also directed to an optical sight for a firearm comprising a reticle including one or more aiming marks and one or more non-aiming marks; wherein at an intended sight picture of the optical sight the one or more aiming marks are in a field of view of the optical sight and the one or more non-aiming marks are outside the field of view of the optical sight.

The present disclosure is also directed to an optical sight for a firearm comprising a reticle projected onto a lens of the optical sight, the reticle comprising one or more aiming marks and one or more non-aiming marks, wherein the one or more aiming marks include a dimension of a first angular measurement and the one or more non-aiming marks include a dimension of a second angular measurement; wherein an operable field of view of the optical sight provides a third angular measurement less than the second angular measurement.

DEFINITIONS USED IN THE DISCLOSURE

Figure 1:
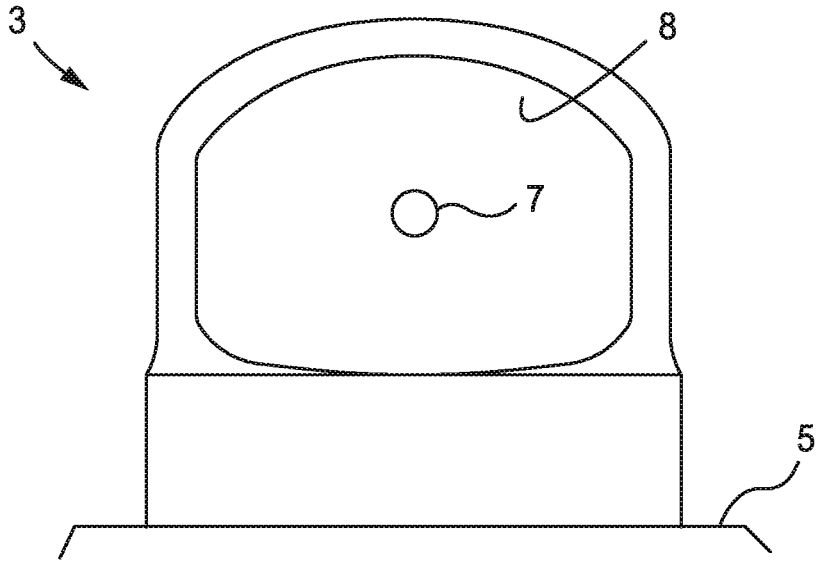
FIG. 1 (PRIOR ART)
FIG. 1 is a front view of an exemplary prior art optical sight for use with a firearm illustrating a reticle centered in a field of view of the optical sight.

The term "at least one", "one or more", and "one or a plurality" mean one thing or more than one thing with no limit on the exact number; these three terms may be used interchangeably within this disclosure. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

DETAILED DESCRIPTION OF THE DISCLOSURE

For the purposes of promoting an understanding of the principles of the present disclosure, reference is now made to the embodiments illustrated in the drawings and particular language will be used to describe the same. It is understood that no limitation of the scope of the claimed subject matter is intended by way of the disclosure. As understood by one skilled in the art to which the disclosure relates, various changes and modifications of the principles as described and illustrated are herein contemplated.

It is to be understood that the present disclosure is not limited to particular embodiments. It is also to be understood that the terminology used herein is for the purpose of describing particular embodiments only and is not intended to be limiting. As used in this specification and the appended claims, the term "optical sight" refers to a non-magnifying (1×) electronic sight for use with firearms. A non-magnifying (1×) electronic sight typically comprises a housing, a partially reflective surface such as a semi-transparent reflective lens or a lens with one or more reflective coatings, and electronic components including a power source and one or more light sources for emitting light towards the partially reflective surface producing a reflective image such as an aiming mark superimposed on a target when sighting through the partially reflective surface. One example of a non-magnifying (1×) electronic sight includes what is commonly referred to as a "reflector sight" or "reflex sight." A reflex sight may be provided as a tube sight or as an open sight, e.g., an "open reflex sight," as such terms are understood by persons of ordinary skill in the art of firearm optics. Operational features regarding non-magnifying (1×) electronic sights are described in various references including, for example, U.S. Pat. No. 5,205,044, titled "Luminous Dot Sighting Instrument," issued on Apr. 27, 1993; U.S. patent application No. 20090193705A1, titled "Sighting Device with Trajectory Compensation," published on Aug. 6, 2009; and U.S. patent application No. 20070214701A1, titled "Weapon Aiming Device," published on Sep. 20, 2007; each of which is herein incorporated by reference in its entirety.

Herein, the phrase "field of view" ("FOV") refers to the visible or observable area through an optical element or lens of an optical sight for an operator of the optical sight, e.g., a shooter, at a particular distance between the operator's eye(s) and the optical element or lens of the optical sight. Typically, the larger the lens of an optical sight the larger the field of view of the optical sight. As understood by persons of ordinary skill in the art of firearm optics, "eye relief" refers to the distance between a shooter's eye(s) and the optical element or lens of an optical sight that allows for an unobstructed, clear image of a desired field of view. As also understood by persons of ordinary skill in the art of firearm optics, a non-magnifying (1×) electronic sight is considered to have unlimited eye relief allowing a shooter to direct the sight away from his/her eye(s) without any shadowing of the non-magnifying (1×) electronic sight.

In terms of operation, the phrase "operable eye distance" refers to one or more distances between a shooter's eye(s) and a lens of one or more optical sights effective for suitable operation of a reticle of the one or more optical sights as described herein. As such, the field of view of a lens of an optical sight at an operable eye distance may be referred to herein as an "operable field of view." The operable eye distance and the operable field of view may vary depending on the optical sight and firearm combination employed. For example, an operable eye distance for an optical sight and pistol combination may be greater than an operable eye distance for an optical sight and rifle combination.

The phrase "time on target" herein refers to the time required for a shooter to direct a firearm from a non-aiming position to an aiming position of an operable sight picture, i.e., the time required to realize an operable sight picture when taking aim at a target with a firearm. The phrase "operable sight picture" refers to an optical sight alignment for a shooter that accurately aims a firearm at an intended target, i.e., the reticle of the optical sight is aligned with an intended target as desired. An operable sight picture at an operable eye distance for a shooter may be referred to herein as an "intended sight picture." Herein, the terms "shooter," "firearm operator," "operator," "firearm user," "optical sight user" and "reticle user" and other like terms may be used interchangeably to describe one or more persons operating an optical sight of this disclosure. For purposes of this disclosure, an average adult male may be considered as standing upright at or about 1.78 meters (70.0 inches) and an average adult female may be considered as standing upright at or about 1.63 meters (64.0 inches).

An optical sight of this disclosure may be configured for use with one or more projectile launching devices, including but not necessarily limited to one or more firearms. Herein, a "firearm" useable with an optical sight of this disclosure may include, but is not necessarily limited to a bolt action rifle, a semi-automatic rifle, a shotgun, and a handgun such as a revolver and a semi-automatic pistol. Exemplary manufacturers of semi-automatic firearms include, but are not necessarily limited to Smith & Wesson, Inc., Springfield, Massachusetts, U.S.A.; Glock, Inc., Smyrna, Georgia, U.S.A; Sig Sauer, Inc., Newington, New Hampshire, U.S.A; Sturm, Ruger & Co., Inc., Southport, Connecticut, U.S.A.; and Heckler & Kock USA, Columbus, Georgia, U.S.A., amongst other manufacturers known to persons of ordinary skill in the art of firearms.

Herein, "MOA" refers to Minutes of Angle, which is an angular measurement wherein one minute of angle is equal to 1/60 of a degree. Herein, "MIL" or "MRAD" is a shortening of the term milliradian and "MILs" and "MRADs" is a shortening of the term milliradians. A milliradian is an angular measurement wherein a milliradian is a thousandth of a radian. There are 6.283 radians in a circle, which equates to 6283.0 milliradians in a circle. For purposes of this disclosure, "milliradian," "MIL" and "MRAD" may be used interchangeably.

In one embodiment, the present disclosure is directed to a system including a firearm and an optical sight attached to the firearm that is operationally configured to visually inform a shooter when an intended sight picture of the optical sight is misaligned. The optical sight comprises a reticle with (1) one or more first visual markings or indicia operationally configured to inform a shooter when the firearm is centered or aligned on an intended target and (2) one or more second visual markings or indicia operationally configured to inform a shooter when the firearm is canted or misaligned from the intended target and the direction of canting or misalignment for rapid correction and accurate firing of the firearm at the intended target. In addition, when the firearm is centered on an intended target the one or more second visual markings or indicia are outside the shooter's operable field of view and do not obstruct the intended target.

In another embodiment, the present disclosure is directed to an optical sight for a firearm comprising a reticle having one or more first markings or indicia located within an operable field of view of the optical sight when the optical sight is aligned with an intended target and one or more second markings or indicia located outside of the operable field of view of the optical sight when the optical sight is aligned with the intended target. In instances when the optical sight becomes canted, at least part of the one or more second marking or indicia enter the operable field of view in a manner effective to visually guide a user of the optical sight back to an intended sight picture.

In another embodiment, the present disclosure is directed to an optical sight of a firearm, the optical sight having a reticle operationally configured to promote the acquisition of an intended sight picture by visually signaling to a user of the optical sight in real time when the firearm is canted or misaligned from an intended target.

In another embodiment, the present disclosure provides an optical sight for one or more firearms comprising a reticle operationally configured to inform a user of the optical sight when the optical sight is misaligned from an intended sight picture when presenting a firearm of the optical sight at a target. The reticle is also operationally configured to inform the firearm user as to the direction to adjust the barrel of the firearm in order to acquire an intended sight picture for accurate firing at a target.

In another embodiment, the present disclosure provides a reticle of an optical sight for a firearm operationally configured to decrease time on target in instances when the firearm is canted from an intended target.

In another embodiment, the present disclosure provides a reticle of an optical sight for a firearm comprising one or more first indicia operationally configured as an aiming mark of the reticle and one or more second indicia set apart from the one or more first indicia wherein the one or more second indicia are outside an operable field of view of the optical sight when the one or more first indicia are in the operable field of view and wherein at least part of the one or more second indicia enters the operable field of view as at least part of the one or more first indicia exits the operable field of view.

In another embodiment, the present disclosure is directed to an optical sight for a combat pistol comprising a reticle having one or more first aiming markings or indicia located within an operable field of view of the optical sight and one or more second non-aiming markings or indicia located outside of the operable field of view of the optical sight when an intended sight picture of the optical sight is realized.

In another embodiment, the present disclosure is directed to an optical sight for a semi-automatic pistol comprising a reticle including a center mark operationally configured as an aiming mark or aiming point of the optical sight on an intended target and one or more non-aiming marks operationally configured as reference points for aligning the center mark with an intended target from a canted position of the pistol.

In another embodiment, the present disclosure provides an optical sight for one or more projectile launching devices including, but not necessarily limited to bows, cross bows, paintball guns, air guns, shoulder fired bazookas, and shoulder fired rocket launchers.

In another embodiment, the present disclosure provides an optical sight for a firearm comprising a reticle having an aiming mark operationally configured as a center aiming mark along an optical axis of the optical sight and one or more non-aiming marks set apart from the aiming mark.

In another embodiment, the present disclosure provides an optical sight for a firearm comprising a reticle having an aiming mark operationally configured as a center aiming mark along an optical axis of the optical sight and one or more non-aiming marks surrounding the aiming mark.

With reference to FIGS. 1-6, a prior art optical sight 3 for a firearm such as a semi-automatic pistol (hereafter "pistol 5") is often provided in the form of a "reflector sight" or "reflex sight," more particularly an "open reflex sight" as shown. A reflex sight may also be provided as a tube sight in another embodiment. As shown in FIG. 1, a known optical sight 3 typically includes a reticle 7 in the form of a circular shape indicia such as a colored circle or colored dot operationally configured as a central aiming mark of the optical sight 3 for aiming a pistol 5 at an intended target 99 to produce an intended sight picture as shown in the simplified illustration of FIG. 2 (see the intended sight picture alignment Arrow A in FIG. 3). One known reticle 7 includes a red dot style reticle and an optical sight 3 equipped with a red dot style reticle is commonly referred to as a "red dot sight." Other reticle 7 colors are known in the art including, but not necessarily limited to green, yellow, blue, cyan, and orange, and other color indicia commercially available at the time of this disclosure.

Figure 2:
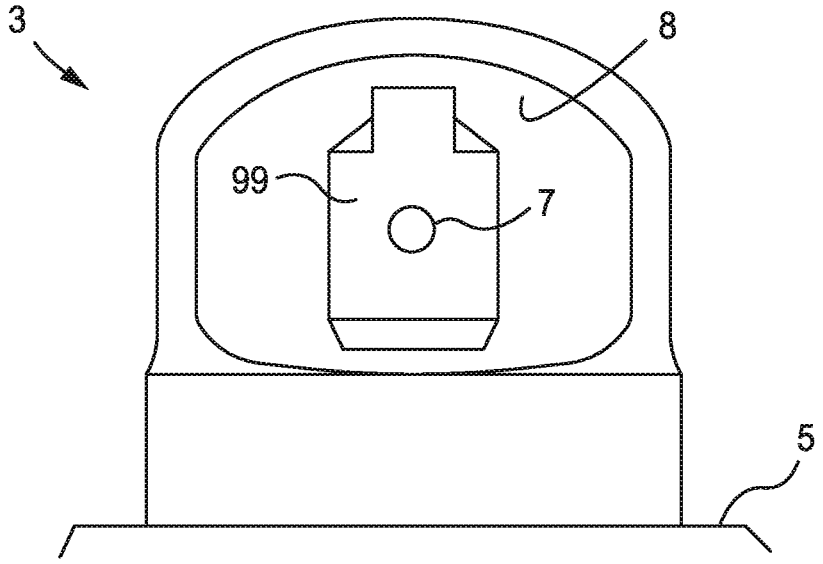
FIG. 2 (PRIOR ART)
FIG. 2 is a front view of the optical sight of FIG. 1 illustrating an exemplary intended sight picture with the reticle of the optical sight aligned on a target.

As understood by the skilled artisan, a reticle 7 is projected onto a partially reflective optical element of an optical sight 3 such as a semi-transparent reflective lens or onto a lens having one or more reflective coatings (hereafter "lens 8") and reflected off the lens 8 in one or more parallel light paths toward the eye(s) of a shooter 29. Thus, the point at which the reticle 7 appears on the lens 8 is dependent on the eye position or line of sight of a shooter 29 relative to the lens 8. For example, to acquire an intended sight picture as shown in FIG. 2 a target 99 must be aligned with the reticle 7 of the optical sight 5 and the line of sight of a shooter 29 (see Arrows A and C in FIG. 3). Any deviation from this position of alignment causes the visible reticle 7 to appear to move away from a center point of the lens 8, i.e., the visible reticle 7 appears to move away from a centered position in the operable field of view.

Because the reticle 7 is operationally configured as a central aiming mark of an optical sight 3, the reticle 7 must be large enough for visible operability but also small enough to provide an accurate aiming point, as a smaller reticle provides a more precise aiming point compared to a similar reticle of a larger size. In addition, the field of view of the optical sight 3 is less obstructed by a smaller reticle 7. As such, a commercially available optical sight 3 is typically provided with a circular shape reticle 7 having an outer diameter ranging from 2.0 MOA to 15.0 MOA. At this size range, a reticle 7 can easily disappear from the operable field of view of the optical sight 3 with even the slightest deviation from the above described alignment position (see FIG. 4).

Figure 3:
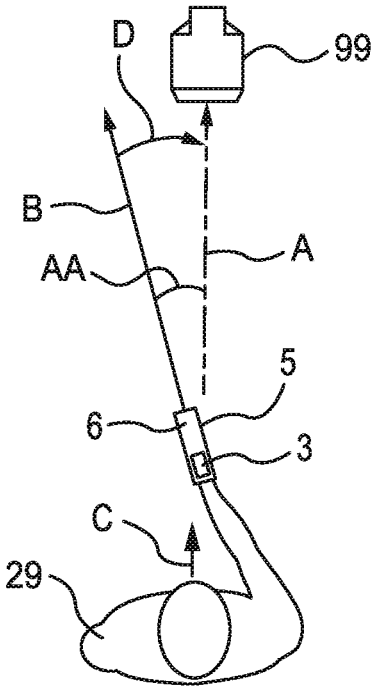
FIG. 3 (PRIOR ART)
FIG. 3 is a simplified top view of a firearm of a shooter in a misalignment position in relation to a desired aiming point of a target resulting in misalignment of the sight picture of FIG. 2.
Figure 4:
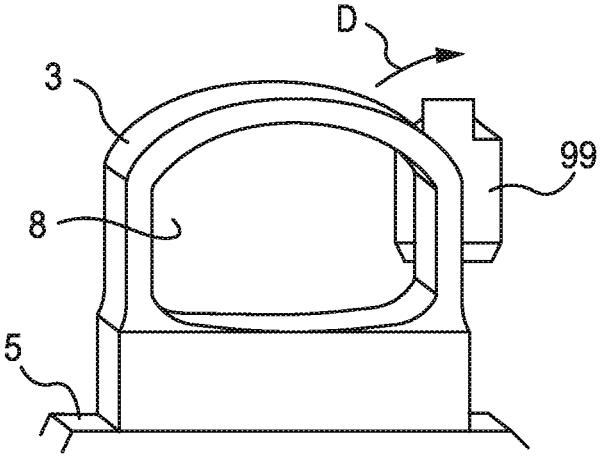
FIG. 4 (PRIOR ART)
FIG. 4 is a front perspective view of the optical sight of FIG. 1 illustrating the misalignment of the sight picture of FIG. 3.

As understood by the skilled artisan, an intended sight picture for a firearm optical sight may be readily obtained when a shooter 29 is not under any time constraints for obtaining the intended sight picture, e.g., when a shooter 29 takes aim at a target 99 during leisure target shooting. However, in high stress type scenarios, e.g., close quarter combat and other combat type scenarios (hereafter "combat"), a shooter 29 armed with a pistol 5 may unintentionally cant the pistol 5, i.e., misalign the barrel 6 of the pistol 5, when rapidly presenting the pistol 5 in an attempt to aim the pistol 5 at an intended target 99 such as an enemy combatant or other target or target object (see misalignment Arrow B in FIG. 3). When the pistol 5 is canted as shown in FIG. 3, a reticle 7 of a size as described above will exit the operable field of view according to the line of sight of a shooter 29 (see Arrow C) with the intended target 99. In an attempt to acquire an intended sight picture, the shooter 29 must take additional time to try and position the reticle 7 back in the operable field of view for firing the pistol 5 at the intended target 99.

With reference to the illustration of FIG. 3, when a shooter 29 unintentionally cants the pistol 5 to the left, i.e., misaligns the barrel 6 of the pistol 5 and an optical axis of the optical sight 3 angularly left of an intended target 99 (see Arrow B), the shooter 29 may successfully align the pistol 5 with the intended target 99 (see Arrow A) by directing the barrel 6 of the firearm 5 angularly to the right (see directional Arrow D) until the intended target 99 and reticle 7 are in the operable field of view producing an intended sight picture as shown in FIG. 2. In natural light and/or artificial lighting conditions, a shooter 29 may rely on his/her ability to see both an intended target 99 and the optical sight 3 to assist in achieving an intended sight picture. However, in low light or dark conditions where an intended target 99 and/or the optical sight 3 may not be easy to see, a shooter 29 may only be aware of the general location of the intended target 99 and may not immediately know the orientation of misalignment of his/her pistol 5 or the direction to adjust the pistol 5 to center the reticle 7 in an operable field of view. Because even a slight angular misalignment of an optical sight 3 results in the reticle 7 exiting the operable field of view, an optical sight 3 as described in reference to FIGS. 1-6 is not ideal for combat including combat conducted in low light or dark conditions as the reticle 7 may be easily lost from the operable field of view during use.

For purposes of the present disclosure, a maximum degree of angular misalignment of an optical sight effective to maintain at least part of a reticle in an operable field of view may be referred to as the "maximum operable angular displacement" of an optical sight. As understood by the skilled artisan, the maximum operable angular displacement may vary amongst different commercially available optical sights according to the size or dimensions of the lens and the size of the reticle projected onto the lens. For example, the maximum operable angular displacement for an optical sight 3 as described in reference to FIGS. 1-6 may be up to or about 5.0 degrees, meaning that at least part of the reticle 7 remains in the operable field of view when the optical sight 3 is directed angularly side to side up to or about 5.0 degrees according to a line of sight of a shooter 29 (see Arrow C). In other words, from a position of alignment with an intended target 99 (see Arrow A), the optical sight 3 may have a maximum operable angular displacement left or right from the position of alignment up to or about 2.5 degrees (see AA in FIG. 3).

Figure 6:
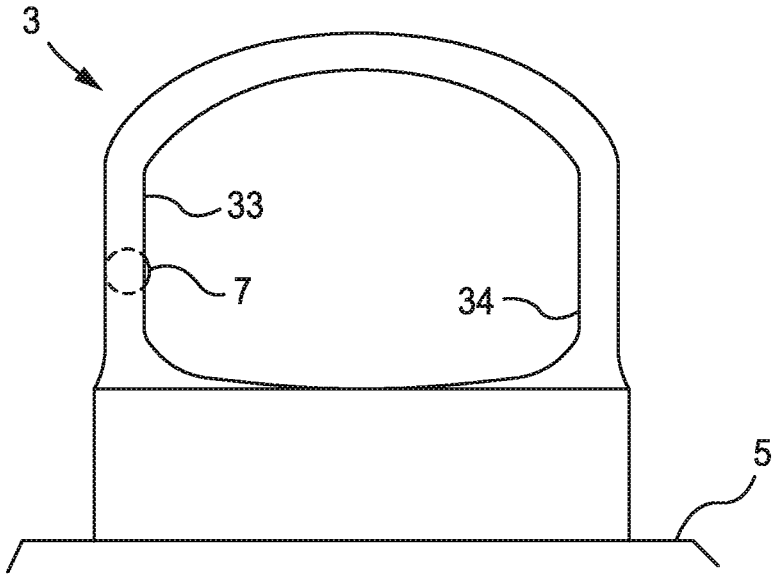
FIG. 6 (PRIOR ART)
FIG. 6 is a front view of the optical sight of FIG. 1 illustrating the optical sight in a misaligned position according to the line of sight of a shooter.
Figure 7:
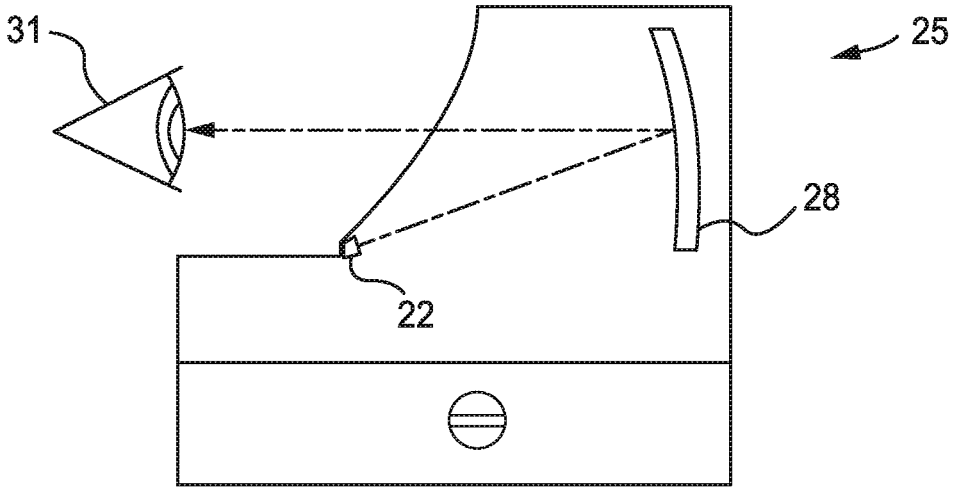
FIG. 7 is a partially phantom side view of a simplified optical sight of the present disclosure.
Figure 8:
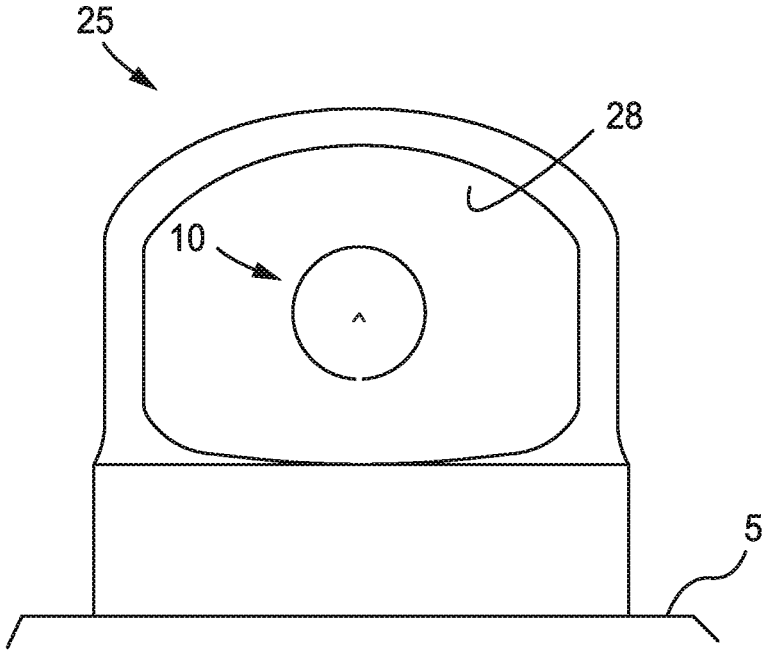
FIG. 8 is a front view of an embodiment of an optical sight of the present disclosure including a reticle in the field of view of the optical sight.
Figure 9:
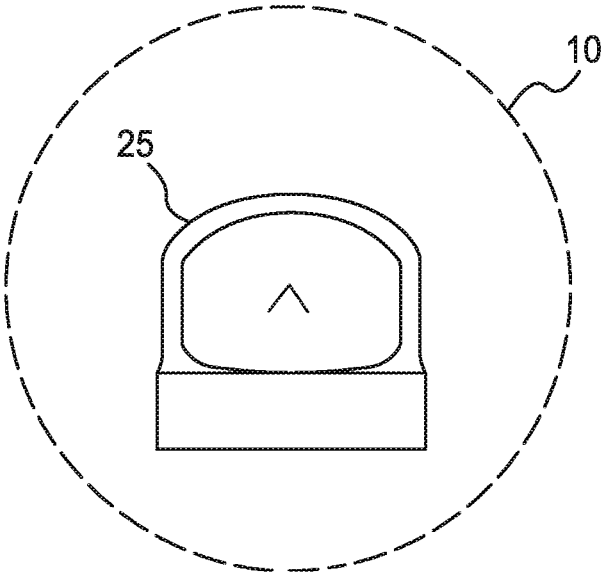
FIG. 9 is a front view of the optical sight of FIG. 8 illustrating part of the reticle in the field of view and part of the reticle out of the field of view of the optical sight.

With reference to FIGS. 7-9, the present disclosure is directed to an optical sight 25 for a firearm comprising a maximum operable angular displacement greater than the maximum operable angular displacement of an optical sight 3 as described above in reference to FIGS. 1-6. Suitably, an optical sight 25 of the present disclosure comprises one or more light sources 22 operationally configured to project a reticle 10 onto a partially reflective optical element or lens 28 of the optical sight 25 in a manner effective to (1) provide a center aiming point for a shooter 29 that may be superimposed on an intended target 99, (2) visually signal or communicate to a shooter 29 when the optical sight 25 is misaligned from an intended sight picture, and (3) visually signal or communicate to a shooter 29 as to the direction of misalignment of the optical sight 25. Said another way, the present disclosure provides an optical sight 25 for a firearm including a reticle 10 that is operationally configured to visibly signal to a shooter 29 when a firearm is canted or misaligned from an intended target 99 according to the line of sight of a shooter 29 and operationally configured to assist a shooter 29 to align the point of aim of the firearm 5 on the intended target 99 in a manner effective to acquire an intended sight picture, even in low light or dark conditions. In one embodiment, a lens 28 of an optical sight 25 may comprise multicoated glass operationally configured to reduce reflection as known in the art of optical sights. As shown in FIG. 7, a lens 28 may include a curved lens operationally configured to produce a desired reflection of the reticle 10.

In one embodiment, the one or more light sources 22 may include one or more light-emitting diodes ("LEDs") or LED array and an accompanying light blocking plate or light blocking mask comprising one or more reticle forming openings there through effective for reducing the size of the exiting light beam(s), e.g., a pinhole aperture producing a dot pattern. As understood by the skilled artisan, a light blocking plate or light blocking mask may be constructed from one or more opaque materials including, but not necessarily limited to one or more metals such as aluminum, chromium, and combinations thereof. In another embodiment, the one or more light sources 22 may include one or more resonant cavity light-emitting diodes ("RCLEDs") or RCLED array operationally configured to emit light to produce a reticle pattern according to the configuration of the RCLED or RCLED array. In another embodiment, the one or more light sources 22 may include a combination of one or more LEDs and one or more RCLEDs. In another embodiment, the one or more light sources 22 may include one or more laser diodes. In another embodiment, the one or more light sources 22 may include one or more tritium illumination sources. In another embodiment, the one or more light sources 22 may include a passive light gathering optical waveguide array. In another embodiment, the one or more light sources 22 may include one or more incandescent bulbs.

The one or more light sources 22 of an optical sight 25 may be operationally configured to produce a reticle 10 having one or more colors as desired. For example, an optical sight 25 of this disclosure may include one or more color LEDs, one or more dual-color LEDs, one or more tri-color LEDs, one or more color RCLEDs, one or more dual-color RCLEDs, one or more tri-color RCLEDs, and combinations thereof. Exemplary reticle 10 colors may include, but are not necessarily limited to red, green, yellow, blue, cyan, orange, and combinations thereof. One or more other reticle 10 colors commercially available at the time of this disclosure may also be employed as desired.

Suitably, an optical sight 25 of this disclosure comprises a reticle 10 that is projected onto a lens 28 at a fixed angular measurement, e.g., fixed MOA or fixed MRAD, whereby the observable reticle 10 for a shooter 29 changes in relation to the distance between the lens 28 of the optical sight 25 and the eye(s) 31 of a shooter 29 using the optical sight 25. In particular, as the distance between a lens 28 of an optical sight 25 and a shooter's eye(s) 31 decreases the field of view increases and the reticle 10 appears smaller to the eye(s) 31 of a shooter 29 in relation to the field of view (see FIG. 8, which depicts an observable reticle 10 at a distance between the eye(s) of a shooter 29 and a lens 28 of an optical sight 25 of about 5.08 cm (2.0 inches)). Conversely, as the distance between a lens 28 of an optical sight 25 and a shooter's eye(s) 31 increases the field of view decreases and the reticle 10 appears larger to the eye(s) 31 of a shooter 29 even to a point where part of the reticle 10 is outside the field of view (see FIG. 9, which depicts part of the observable reticle 10 of FIG. 8 in the field of view of the optical sight 25 and part of the reticle 10 outside the field of view at a distance between the eye(s) 31 of a shooter 29 and a lens 28 of an optical sight 25 of or about 60.96 cm (24.0 inches)).

The angular measurement of a reticle 10 for a particular optical sight 25 may be determined as desired to produce an observable reticle 10 during operation of the optical sight 25, i.e., to produce a reticle 10 observable in an operable field of view through a desired degree of angular displacement of the optical sight 25. In one embodiment, the angular measurement of a reticle 10 as projected onto a lens 28 may be determined, at least in part, according to a predetermined operable eye distance for an optical sight 25 and the dimensions of the lens 28 providing a field of view of particular angular measurement at the operable eye distance. For purposes of this disclosure, an operable eye distance may be determined, at least in part, according to (1) the length of a particular shooter's 29 arm(s) or a predetermined average arm length, and/or (2) the type of firearm 5 using the optical sight 25, and/or (3) the intended manner in which a firearm 5 is to be held by a shooter 29 when using an optical sight 25 of this disclosure.

In an embodiment of an optical sight 25 comprising one or more RCLEDs, the one or more RCLEDs may be provided in a size and shape effective to project a reticle 10 of a desired angular measurement onto a lens 28 of the optical sight 25 according to (1) the dimensions of the lens 28 and (2) the distance between the lens 28 and a projection point of the one or more RCLEDs to provide an observable reticle 10 at a predetermined operable eye distance for the optical sight 25. In another embodiment of an optical sight 25 comprising one or more RCLEDs, the one or more RCLEDs may be provided in a size and shape effective to project a reticle 10 of a desired angular measurement onto a lens 28 of the optical sight 25 according to (1) the dimensions of the lens 28 and (2) the distance between the one or more RCLEDs and a dichroic coating disposed between a first lens element and a second lens element of the lens 28. In an embodiment of an optical sight 25 comprising one or more LEDs and an accompanying light blocking plate, the one or more openings of the light blocking plate may be provided in a size and shape effective to project a reticle 10 of a desired angular measurement onto a lens 28 of the optical sight 25 according to (1) the dimensions of the lens 28 and (2) the distance between the lens 28 and the one or more openings of the light blocking plate.

Figure 10:
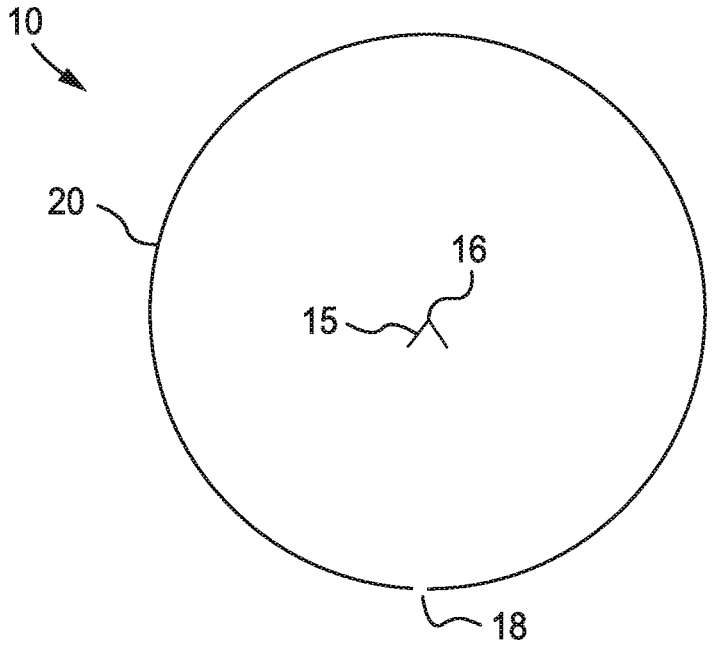
FIG. 10 is a front view of an embodiment of a reticle of an optical sight of the present disclosure.

With reference to FIG. 10, a reticle 10 of this disclosure suitably comprises at least (1) one or more primary marks or "aiming marks 15" and (2) one or more secondary marks or "non-aiming marks 20" disposed around and spaced apart from the one or more aiming marks 15 wherein the one or more aiming marks 15 define a center point of the reticle 10 and the one or more non-aiming marks 20 defining a perimeter of the reticle 10. As shown in the embodiment of FIG. 10, the one or more aiming marks 15 may be provided as a single chevron type aiming mark or indicia and the one or more non-aiming marks 20 may be provided as a circular type single indicia disposed around the aiming mark 15 wherein an uppermost edge of the aiming mark 15, e.g., an upper tip 16 of the chevron type aiming mark 15, defines a center point of the reticle 10. In this embodiment, the reticle 10 may be produced using a first RCLED to generate the aiming mark 15 and a second RCLED to generate the non-aiming mark 20. As understood by the skilled artisan, the second RCLED includes a configuration effective to generate the non-aiming mark 20 as shown wherein the opening 18 or break at or near the bottommost part of the non-aiming mark 20 corresponds to the positive and negative leads at the opposing ends of the RCLED providing electrical communication between the RCLED and electric circuitry of the optical sight 25. As such, the non-aiming mark 20 of this embodiment may be referred to as an open circle or open circle non-aiming mark. In another embodiment, an RCLED may be oriented in a different position effective to produce an opening 18 at a location other than a bottommost part of the non-aiming mark 20 as shown in FIG. 10. In another embodiment, a plurality of RCLEDs may be employed to form a circular type non-aiming mark 20 comprising a plurality of curved indicia with openings or gaps there between. In still another embodiment, a circular type non-aiming mark 20 of a reticle 10 may be provided as a single complete or closed circle non-aiming mark according to one or more other light source configurations effective to project a reticle 10 onto a lens 28 of an optical sight 25.

A reticle 10 of this disclosure is not limited to any particular configuration, but may vary according to one or more anticipated uses of the optical sight 25 and/or according to one or more user preferences. Non-limiting examples of aiming mark 15 indicia may include, but are not necessarily limited to one or more chevrons, one or more circular type marks such as one or more dots (see FIG. 11) and/or one or more circles, one or more triangles or pyramids, one or more ovals, one or more arrows, one or more rectangles, one or more inverted chevrons, one or more inverted triangles or pyramids, one or more vertical lines, one or more horizontal lines, one or more diagonal lines, one or more curved lines, one or more irregular shapes, one or more crosshair or "+" marks, one or more "X" marks, one or more "T" marks, one or more inverted "T" marks, one or more other indicia comprising interconnected lines, and combinations thereof. In addition, the one or more aiming marks 15 may be provided as solid indicia or provided empty with borders of solid lines and/or broken lines and/or as a collection of dots or other marks. Non-limiting examples of non-aiming mark 20 indicia may include, but are not necessarily limited to one or more chevrons, one or more dots, one or more circles, one or more triangles or pyramids, one or more ovals, one or more arrows, one or more rectangles, one or more inverted chevrons, one or more inverted triangles or pyramids, one or more vertical lines, one or more horizontal lines, one or more diagonal lines, one or more curved lines, one or more irregular shapes, one or more crosshair or "+" marks, one or more "X" marks, one or more "T" marks, one or more inverted "T" marks, one or more other indicia comprising interconnected lines, and combinations thereof. In addition, the one or more non-aiming marks 20 of a reticle 10 may comprise a plurality of indicia spaced apart effective to form one or more non-aiming mark 20 configurations, e.g., a plurality of solid lines and/or broken lines and/or a collection of dots effective to form one or more particular non-aiming marks 20. In another embodiment, a reticle 10 of this disclosure may include one or more additional non-aiming tertiary marks 30 located between the one or more aiming marks 15 and the one or more non-aiming marks 20 as shown in the non-limiting embodiment of FIG. 12. The one or more tertiary marks 30 may include one or more indicia as described above in reference to the aiming mark 15 indicia and non-aiming mark 20 indicia.

Figure 13:
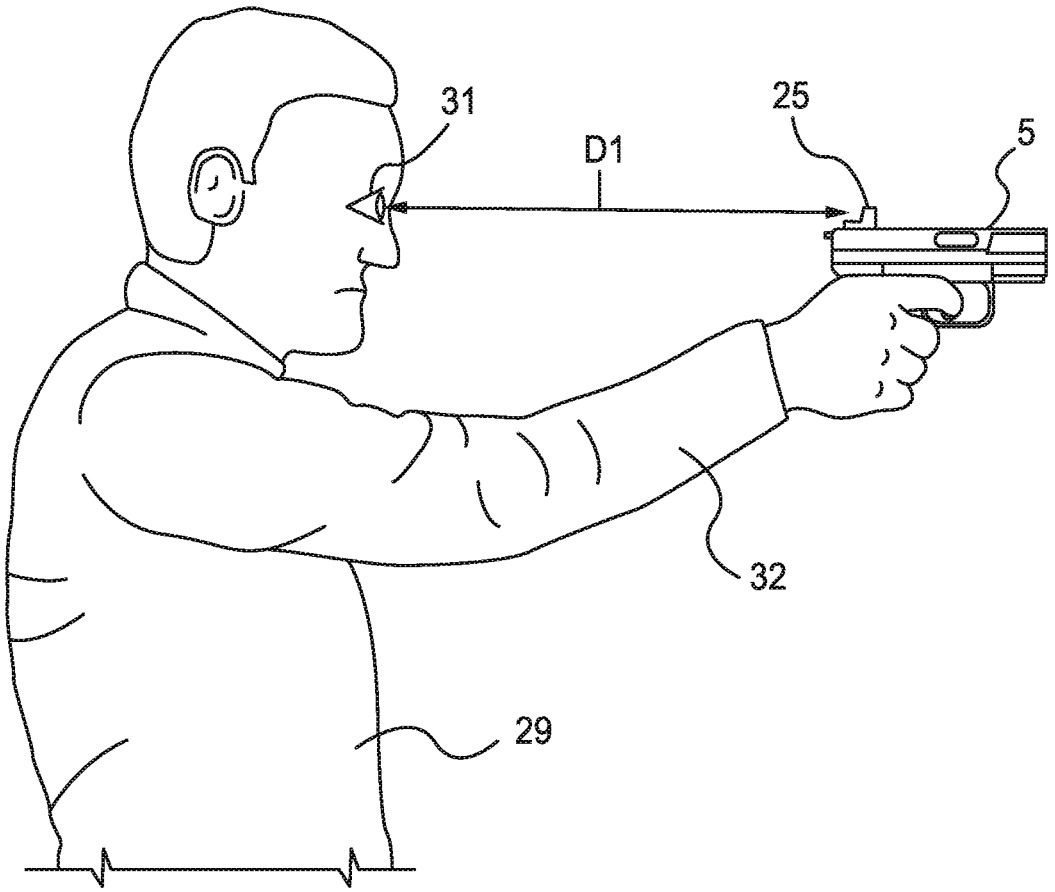
FIG. 13 is a side perspective view of a shooter presenting a pistol equipped with an exemplary optical sight of the present disclosure at a target.

Exemplary operation of an optical sight 25 of this disclosure is described below in reference to FIGS. 13-21 including operation of an optical sight 25 in connection with a pistol 5. As depicted in FIG. 13, an optical sight 25 is suitably mounted to a slide portion of a pistol 5 or attached to a mounting device that is secured to the slide portion of the pistol 5 and viewed by a shooter 29 when the shooter 29 presents the pistol 5 with one or both arms 32 fully extended or substantially fully extended as shown. Suitably, the distance between a lens 28 of the optical sight 25 and the shooter's eye(s) 31 represents an operable eye distance D1 for the optical sight 25. Although the operable eye distance D1 may vary amongst shooters, in an embodiment of an optical sight 25 for use by average adult male shooters and average adult female shooters, an optical sight 25 of this disclosure is operationally configured for use at an operable eye distance D1 ranging from or about 45.72 cm (18.0 inches) to or about 76.2 cm (30.0 inches). Herein, one suitable operable eye distance D1 may include a distance of or about 60.96 cm (24.0 inches).

Figure 14:
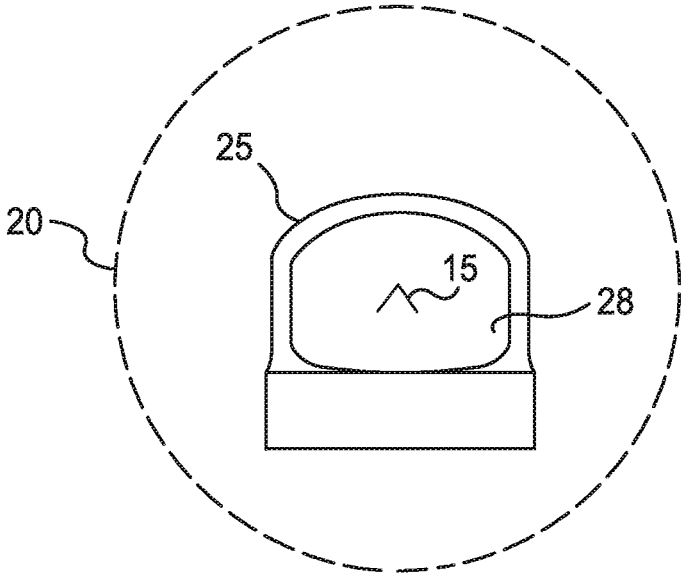
FIG. 14 is a front view of the optical sight of FIG. 8 illustrating a centered reticle with part of the reticle in the field of view and part of the reticle out of the field of view of the optical sight.
Figure 15:
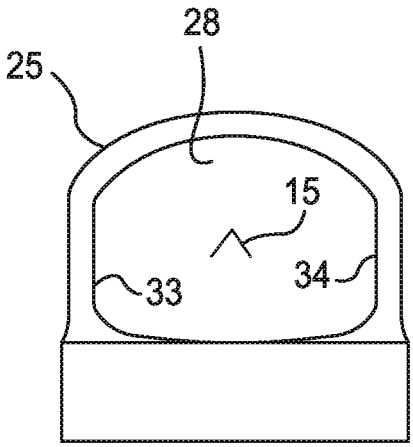
FIG. 15 is a front view of the optical sight of FIG. 9 illustrating only the part of the reticle in the field of view of the optical sight.

As shown in FIGS. 14 and 15, when the optical sight 25 is at the operable eye distance D1 and the reticle 10 is centered on a lens 28 of the optical sight 25 the one or more aiming marks 15 are in the operable field of view at or near a center point of the lens 28 of the optical sight 25 and the one or more non-aiming marks 20 are located outside the operable field of view of the optical sight 25. When the pistol 5 is canted, i.e., when the pistol 5 and the optical axis of the optical sight 25 are directed to an aiming position other than an alignment position with an intended target 99 according to the line of sight of a shooter 29, the one or more aiming marks 15 are directed away from the center point of the lens 28 and at least part of the one or more non-aiming marks 20 is directed toward the operable field of view of the lens 28 resulting in a non-centered reticle 10 of the optical sight 25.

Figure 16:
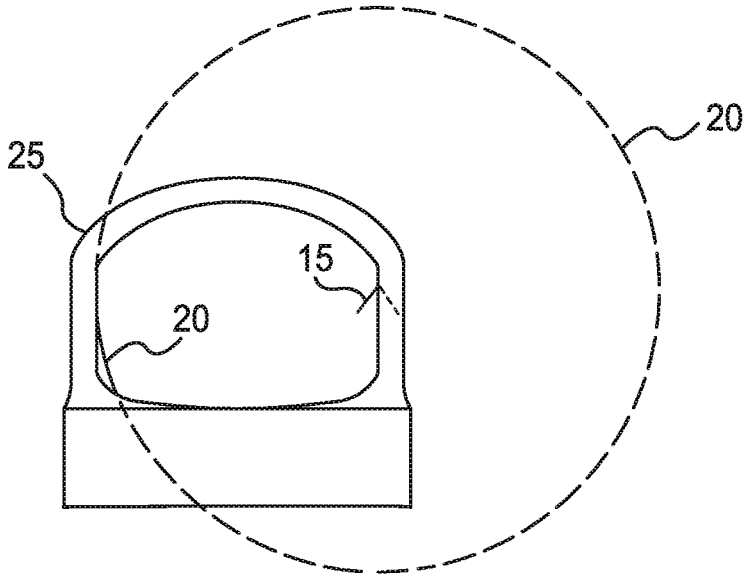
FIG. 16 is a front view of the optical sight of FIG. 9 illustrating the reticle in an off-center position.

As depicted in FIG. 16, an optical sight 25 may be operationally configured whereby at least part of the one or more non-aiming marks 20 enters the operable field of view as the one or more aiming marks 15 exits the operable field of view of the optical sight 25. In other words, the one or more aiming marks 15 and the one or more non-aiming marks 20 may comprise angular measurements and be spaced apart on the lens 28 of the optical sight 25 so that the one or more aiming marks 15 exit the field of view at the same time that at least part of the one or more non-aiming marks 20 enter the field of view. When presenting a pistol 5 at an intended target 99, the appearance of the one or more aiming marks 15 in the operable field of view visibly communicates to a shooter 29 that the optical sight 25 has acquired an intended sight picture or, at a minimum, that the shooter 29 may achieve one or more hits on an intended target 99, e.g., an enemy combatant at close range such as 10.0 meters or less (32.8 feet or less). Likewise, the appearance of at least part of one or more non-aiming marks 20 in the operable field of view visibly communicates to a shooter 29 that the optical sight 25 is misaligned from an intended target 99 or intended sight picture and the part of the one or more non-aiming marks 20 in the operable field of view visibly communicates to the shooter 29 the direction of misalignment of the optical sight 25. As such, the optical sight 25 is operationally configured so that the reticle 10 provides a shooter 29 with constant visual communication as to the orientation of the pistol 5 and optical sight 25 in relation to an intended target 99 according to the line of sight of the shooter 29.

Figure 17:
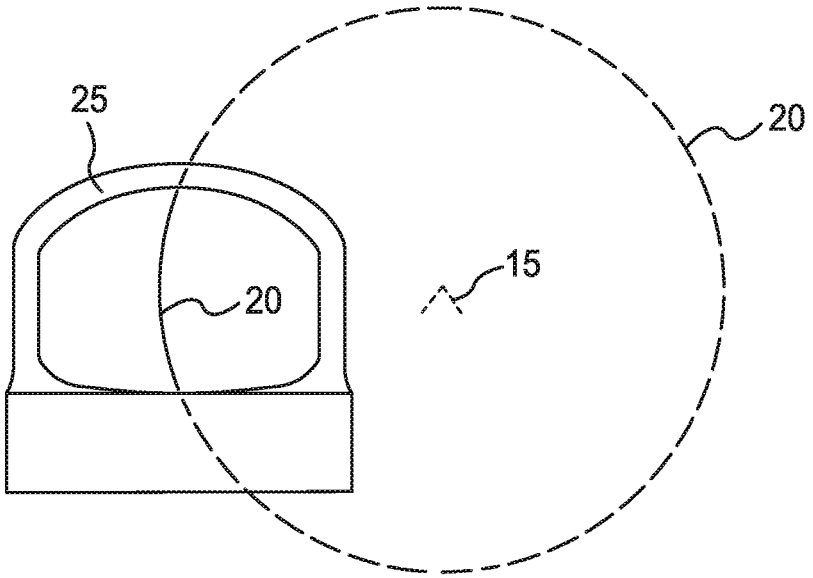
FIG. 17 is a front view of the optical sight of FIG. 9 illustrating the reticle in an off-center position.
Figure 18:
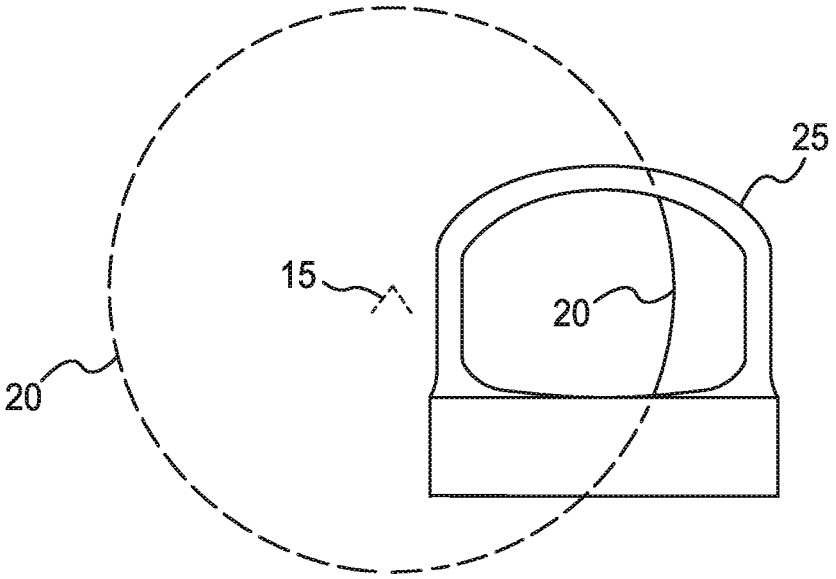
FIG. 18 is a front view of the optical sight of FIG. 9 illustrating the reticle in an off-center position.
Figure 19:
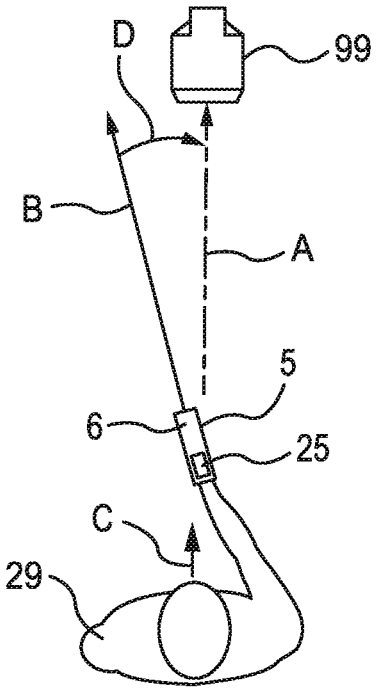
FIG. 19 is a simplified top view of a shooter presenting a pistol in a canted position in relation to an intended aiming point of a target.
Figure 20:
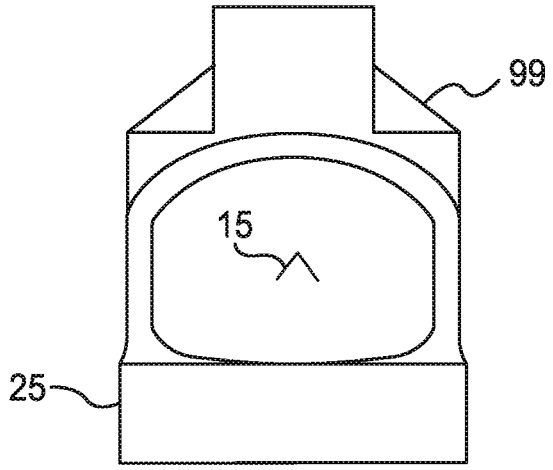
FIG. 20 is a front view of the optical sight of FIG. 8 illustrating an intended sight picture with the reticle of the optical sight aligned on an intended target.
Figure 21:
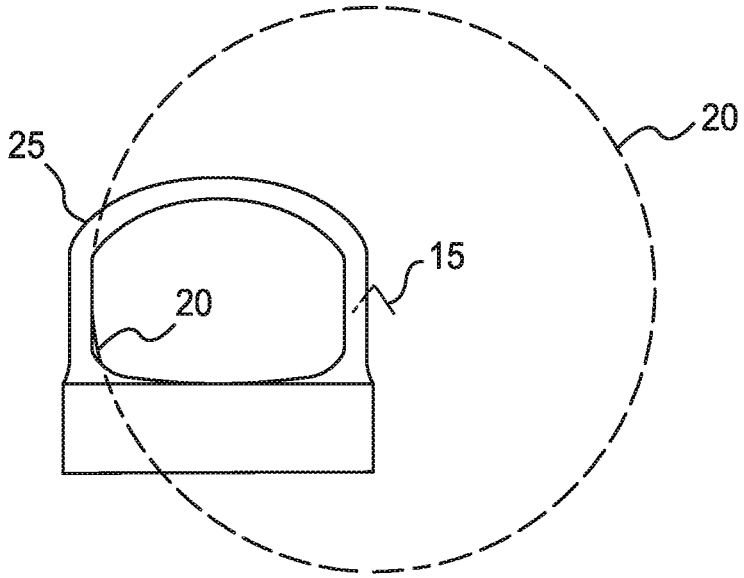
FIG. 21 is a front view of an embodiment of an optical sight illustrating a reticle of the optical sight in an off-center position.

Referring to FIGS. 17-20, if the one or more aiming marks 15 are directed further from the operable field of view, a larger part of the one or more non-aiming marks 20 enters the operable field of view. With knowledge of the configuration of the one or more non-aiming marks 20 of a reticle 10 of an optical sight 25, a shooter 29 can visually identify the direction of misalignment of the optical sight 25 based on the part of the one or more non-aiming marks 20 in the operable field of view. For example, in FIG. 17 part of a left side of the circular type non-aiming mark 20 is in the operable field of view effective to visibly communicate to a shooter 29 that his/her pistol 5 is canted to the left of an aiming point on an intended target 99. In FIG. 18, part of a right side of the circular type non-aiming mark 20 is in the operable field of view visibly communicating to a shooter 29 that the pistol 5 is canted to the right of an aiming point on an intended target 99. Referring again to FIG. 17, when a shooter 29 presents the pistol 5 out toward an intended target 99 and views a misaligned sight picture including part of a left side of the circular type non-aiming mark 20 in the operable field of view, the shooter 29 instantly knows to adjust the orientation of the pistol 5 by moving or directing the pistol 5 angularly rightward (see Arrow D in FIG. 19) to acquire an intended sight picture as shown in FIG. 20 including the one or more aiming marks 15 centered on the lens 28 and superimposed on the intended target 99.

As stated above, for any one optical sight 25 configuration, the angular measurements of the one or more aiming marks 15 and one or more non-aiming marks 20 on a lens 28 may be established, at least in part, according to a predetermined operable eye distance for an optical sight 25 and the dimensions of a lens 28 of an optical sight 25 providing a field of view of particular angular measurement at the operable eye distance. Generally, the angular measurement of the field of view may be measured according to the largest dimension of the lens 28 of an optical sight 25 at an operable eye distance for the optical sight 25. For example, in an embodiment of an optical sight 25 as shown in FIGS. 14 and 15 the angular measurement of the field of view may be measured according to the width of the lens 28, which is greater than the height of the lens 28.

In one embodiment of an optical sight 25, the perimeter of the reticle 10 as defined by the one or more non-aiming marks 20 may include an inner width or diameter of an angular measurement twice, or about twice, the angular measurement of the field of view of the optical sight 25 at an operable eye distance D1. For example, in an embodiment of an optical sight 25 as shown in FIGS. 14 and 15 operationally configured for use at an operable eye distance D1 of or about 60.96 cm (24.0 inches) including a lens 28 having a width of 22.0 mm (0.87 inches) and a field of view of 80.0 MOA from a left side edge 33 to a right side edge 34 of the lens 28 at the operable eye distance D1, the circular type non-aiming mark 20 comprises an inner diameter of 160.0 MOA. In this embodiment, when the center of the aiming mark 15, e.g., upper tip 16 of the chevron type aiming mark 15, is positioned or located at the center of the lens 28 the upper tip 16 is 40.0 MOA from either side edge 33, 34 of the lens 28 and 80.0 MOA from the left most part of the non-aiming mark 20 and 80.0 MOA from the right most part of the non-aiming mark 20. Referring to FIG. 16, as the upper tip 16 of the aiming mark 15 exits the field of view at either side edge 33 or 34, at least part of the non-aiming mark 20 enters the field of view.

With further reference to FIGS. 14 and 15, in another embodiment including a lens 28 having a field of view of 100.0 MOA from a left side edge 33 to a right side edge 34 of the lens 28 of the optical sight 25 at the operable eye distance D1, the circular shape non-aiming mark 20 includes an inner diameter of 200.0 MOA. In such embodiment, when the upper tip 16 of the chevron type aiming mark 15 is positioned or located at the center of the lens 28, the upper tip 16 of the chevron type aiming mark 15 is 50.0 MOA from either side edge 33, 34 and 100.0 MOA from the left most part of the non-aiming mark 20 and 100.0 MOA from the right most part of the non-aiming mark 20.

Suitably, the one or more aiming marks 15 and the one or more non-aiming marks 20 of a reticle 10 may include angular units of measurement as desired. Without limiting the disclosure, for pistol 5 related operation and depending on the configuration of the reticle 10, the one or more aiming marks 15 may include an outer width or outer diameter ranging from or about 1.0 MOA to or about 20.0 MOA and a height ranging from or about 1.0 MOA to or about 20.0 MOA and the one or more non-aiming marks 20 may include an inner width or inner diameter up to or about 500.0 MOA, and a height up to or about 500.0 MOA. In embodiments including a reticle 10 comprising one or more line type indicia, the line thickness of the one or more aiming marks 15 and/or the one or more non-aiming marks 20 may range from or about 0.5 MOA to or about 5.0 MOA. In one embodiment, line type indicia may include a uniform thickness. In another embodiment, line type indicia may include a non-uniform thickness.

In one embodiment of an optical sight 25 for pistol 5 use, a chevron type aiming mark 15 as shown in FIG. 14 and as described with reference to FIG. 16 may include a width at its base of or about 13.36 MOA and a total height of or about 10.0 MOA. In addition, the two opposing legs of a chevron type aiming mark 15 may each have a thickness of or about 0.8 MOA and the non-aiming mark 20 may have a line thickness ranging from or about 0.75 MOA to or about 1.0

Figure 11:
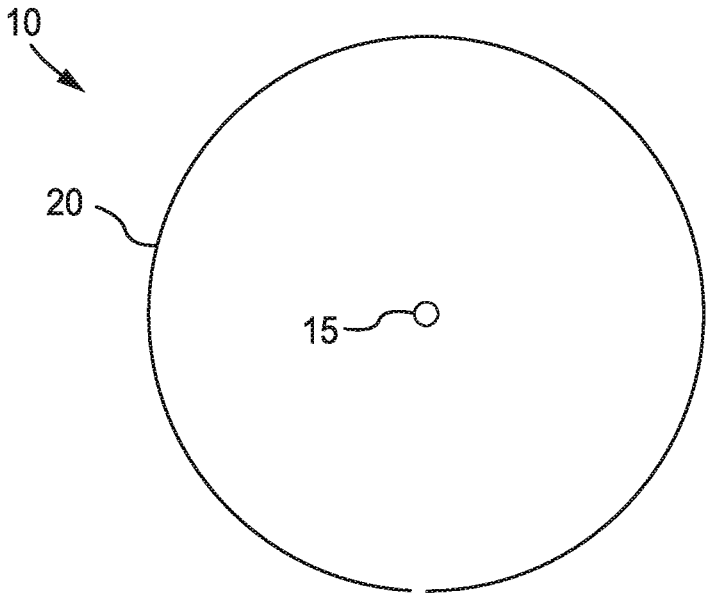
FIG. 11 is a front view of an embodiment of a reticle of an optical sight of the present disclosure.
Figure 12:
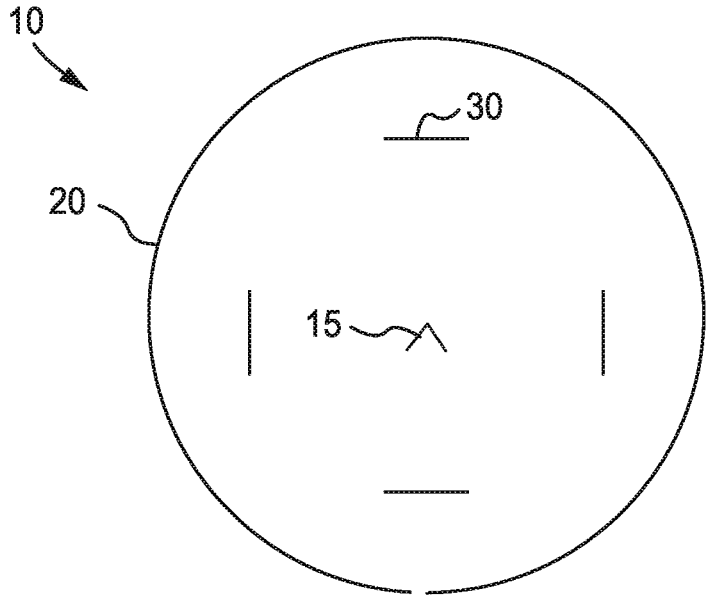
FIG. 12 is a front view of an embodiment of a reticle of an optical sight of the present disclosure.

MOA. As understood by the skilled artisan, the smaller or thinner the indicia of a reticle 10 the more precise the angular measurement of the reticle 10, which typically produces a more accurate reticle 10 and an optical sight 25 with a less obstructed field of view. In another embodiment including a dot aiming mark 15 as shown in FIG. 11, or other circular type aiming mark 15, the aiming mark 15 may include an outer diameter ranging from or about 13.0 MOA to or about 14.0 MOA for operation of the reticle 10 as described with reference to FIG. 16 wherein at least part of the non-aiming mark 20 enters the operable field of view as a vertical midpoint of the aiming mark 15 exits the operable field of view.

In another embodiment, at least part of the one or more aiming marks 15 may intersect or otherwise extend out beyond the perimeter forming one or more non-aiming marks 20. For example, in one non-limiting embodiment of an optical sight 25 including a reticle 10 comprising a chevron type aiming mark 15 and an open circle non-aiming mark 20 the two opposing legs of the chevron type aiming mark 15 may be projected onto a lens 28 in a manner whereby the two opposing legs extend beyond the open circle non-aiming mark 20 wherein each leg of the chevron type aiming mark 15 comprises a length in angular units of measurement greater than the radius of the open circle non-aiming mark 20. In such an embodiment, the angular measurement of the outer width of the base of the chevron type aiming mark 15 may be determined according to the angle formed by the two opposing legs of the chevron type aiming mark 15.

Figure 22:
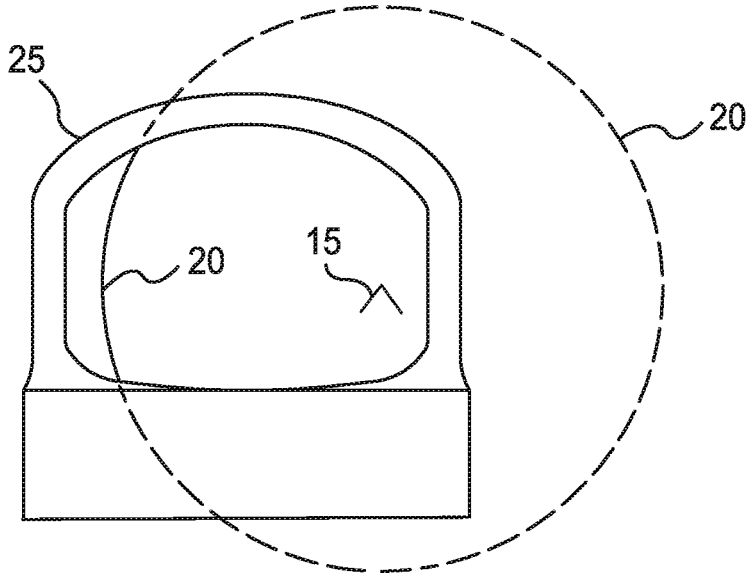
FIG. 22 is a front view of an embodiment of an optical sight illustrating a reticle of the optical sight in an off-center position.

In another embodiment of an optical sight 25, the angular measurements of the one or more aiming marks 15 and the one or more non-aiming marks 20 of the reticle 10 may include one or more variations from the embodiment of FIGS. 16-18, thereby altering the timing of when at least part of the one or more non-aiming marks 20 enters the operable field of view in relation to the position of the one or more the aiming marks 15. In one non-limiting embodiment, at least part of the one or more non-aiming marks 20 may enter the operable field of view as the entire one or more aiming marks 15 exit the field of view. For example, in the embodiment of FIG. 21 as the entire chevron type aiming mark 15 exits the field of view at least part of the circular type non-aiming mark 20 simultaneously enters the operable field of view. In another non-limiting embodiment, at least part of the one or more non-aiming marks 20 may enter the operable field of view when at least part of the one or more aiming marks 15 are also in the operable field of view, e.g., see FIG. 22, thereby visually communicating to a shooter 29 that an intended sight picture of the optical sight 25 is misaligned and the direction of misalignment. In another embodiment of an optical sight 25, when the optical sight 25 is located at an operable eye distance D1 and the reticle 10 is centered on the optical sight 25 the one or more non-aiming marks 20 form a perimeter of the reticle 10 of a fixed angular measurement equal to or about equal to the angular measurement of the field of view of the optical sight 25 at the operable eye distance D1.

Figure 23:
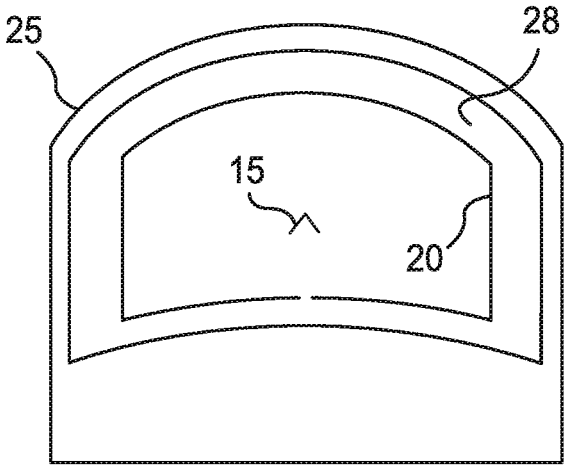
FIG. 23 is a front view of an embodiment of an optical sight of the present disclosure including a reticle in a field of view of the optical sight.
Figure 24:
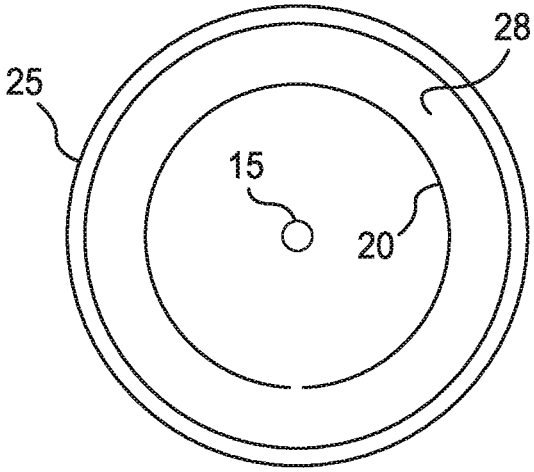
FIG. 24 is a front view of an embodiment of an optical sight of the present disclosure including a reticle in a field of view of the optical sight.
Figure 25:
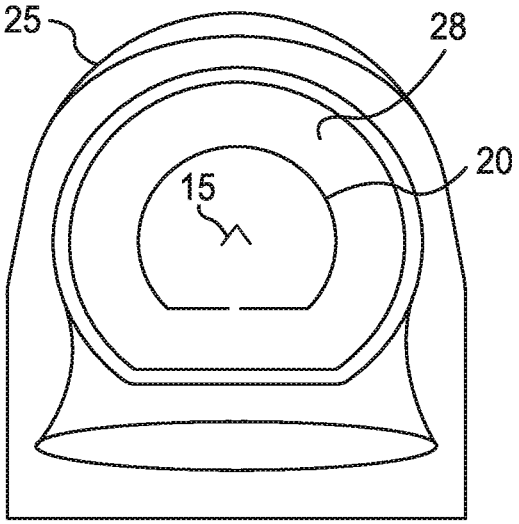
FIG. 25 is a front view of an embodiment of an optical sight of the present disclosure including a reticle in a field of view of the optical sight.
Figure 26:
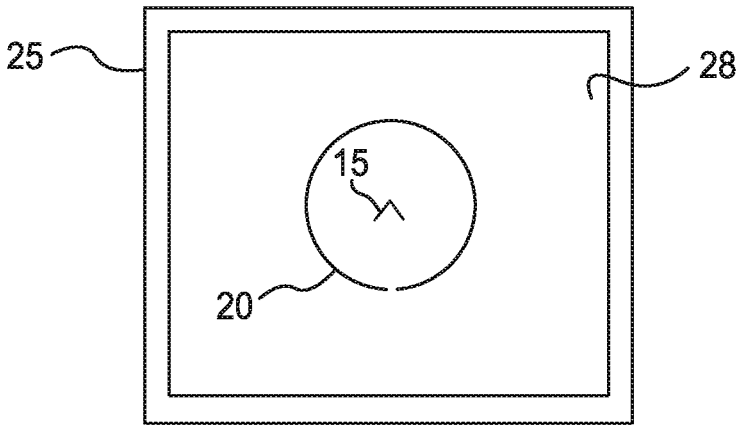
FIG. 26 is a front view of an embodiment of an optical sight of the present disclosure including a reticle in a field of view of the optical sight.
Figure 27:
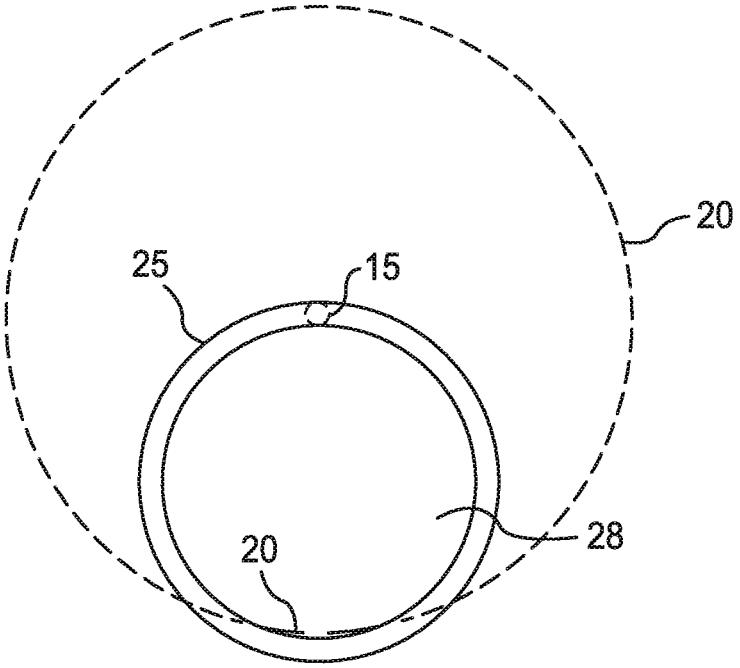
FIG. 27 is a front view of the optical sight of FIG. 24 illustrating the reticle of the optical sight in an off-center position.
Figure 28:
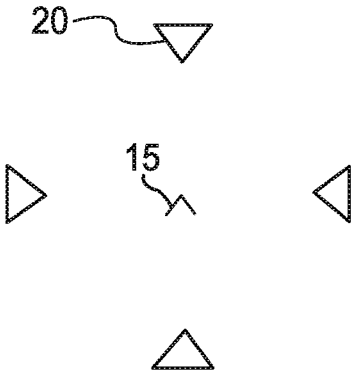
FIG. 28 is a front view of an embodiment of a reticle of the present disclosure.
Figure 29:
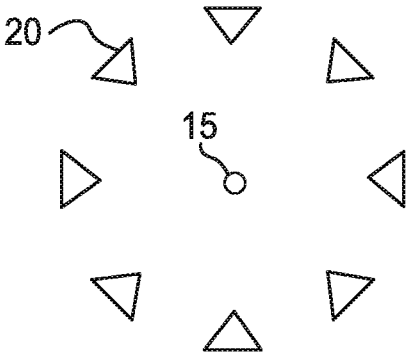
FIG. 29 is a front view of an embodiment of a reticle of the present disclosure.
Figure 30:
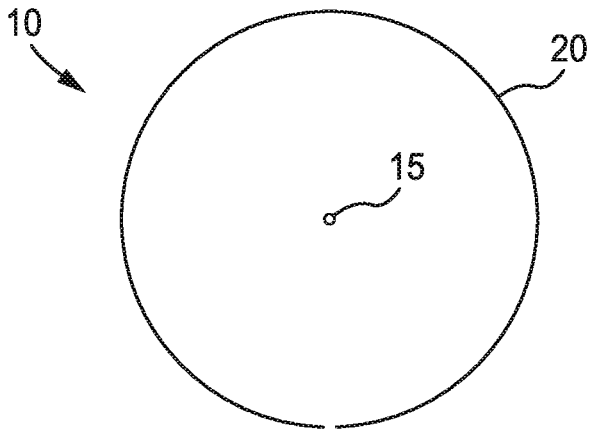
FIG. 30 is a front view of an embodiment of a reticle of the present disclosure.
Figure 31:
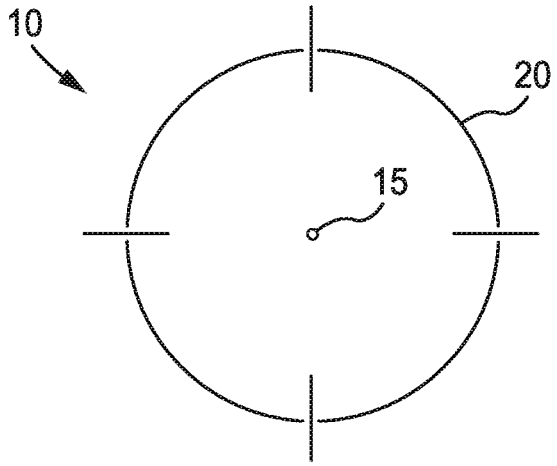
FIG. 31 is a front view of an embodiment of a reticle of the present disclosure.
Figure 32:
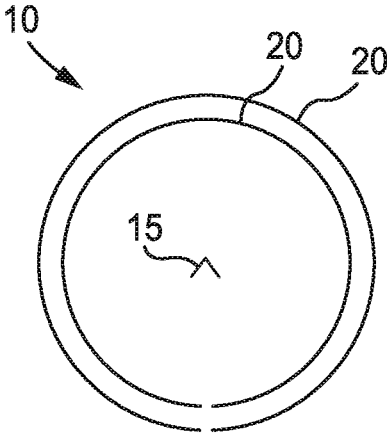
FIG. 32 is a front view of an embodiment of a reticle of the present disclosure.
Figure 33:
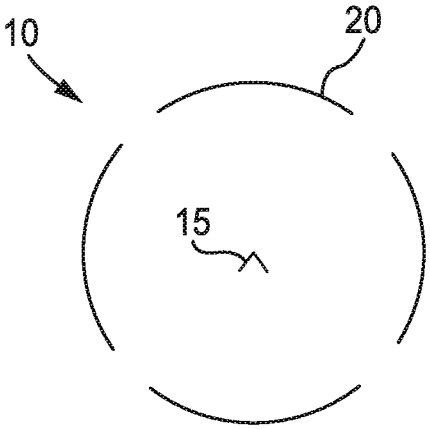
FIG. 33 is a front view of an embodiment of a reticle of the present disclosure.
Figure 34:
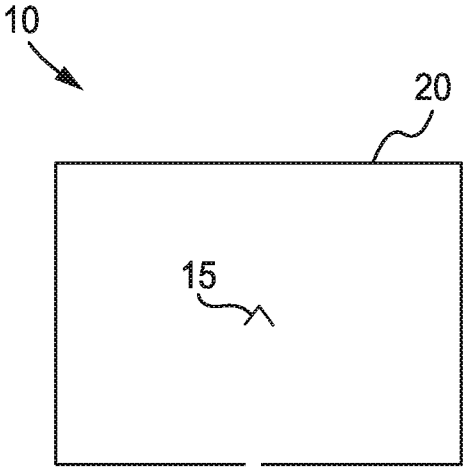
FIG. 34 is a front view of an embodiment of a reticle of the present disclosure.
Figure 35:
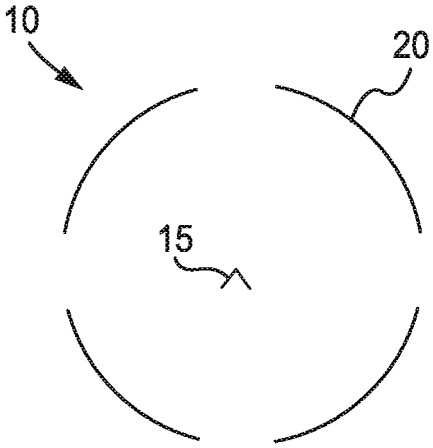
FIG. 35 is a front view of an embodiment of a reticle of the present disclosure.

Although a reticle 10 as described in FIGS. 13-22 comprises a single circular type non-aiming mark 20, in another embodiment the reticle 10 may comprise one or more non-aiming marks 20 providing a shape the same as or substantially similar as the perimeter shape of a corresponding lens 28 of the optical sight 25. For example, in the non-limiting embodiments of FIGS. 23-25, the angular measurements of the one or more aiming marks 15 and the one or more non-aiming marks 20 may be established whereby at least part of the one or more non-aiming marks 20 enter the operable field of view as, before, or after the one or more aiming marks 15 exit the operable field of view in any one direction according to the perimeter shape of the one or more non-aiming marks 20 and the perimeter shape of the corresponding lens 28. In an embodiment of an optical sight 25 as shown in FIG. 24 including a lens 28 having a circular perimeter and a circular type non-aiming mark 20, the optical sight 25 may be operationally configured so that at least part of the non-aiming mark 20 enters the operable field of view at the moment the entire aiming mark 15 exits the operable field of view radially 360.0 degrees as illustrated in FIG. 27. Other non-limiting reticle 10 configurations are provided as shown in FIGS. 28-35. Regardless the configuration of the reticle 10, the one or more non-aiming marks 20 suitably comprise a size and/or shape instantly viewable and recognizable by a shooter 29 when at least part of the one or more non-aiming marks 20 enters the operable field of view wherein a shooter 29 can instantly visibly recognize misalignment of the optical sight 25, the degree of misalignment of the optical sight 25, and the direction of misalignment of the optical sight 25 when presenting a pistol 5 based on the part of the one or more non-aiming marks 20 in the operable field of view.

An optical sight 25 of this disclosure may also include electric circuitry operationally configured for single-mode or multi-mode operation. For example, an optical sight 25 may be provided as a multi-mode optical sight 25 including a manual electric switch operationally configured to alternate the projection of a reticle 10 between a complete reticle 10 including the one or more aiming marks 15 and the one or more non-aiming marks 20 and a reticle 10 projecting only the one or more aiming marks 15 of the reticle 10. As described above, an optical sight 25 of this disclosure may comprise an illuminated reticle 10 produced via one or more LEDS and/or one or more RCLEDs amongst other light sources. As such, an optical sight 25 of this disclosure may be operationally configured to isolate illumination to the one or more aiming marks 15 in a first mode of operation by limiting electric power to the one or more light sources that produce the one or more aiming marks 15 and in a second mode of operation illuminate both the one or more aiming marks 15 and the one or more non-aiming marks 20 by powering the one or more light sources producing both the one or more aiming marks 15 and the one or more non-aiming marks 20.

The disclosure will be better understood with reference to the following non-limiting examples, which are illustrative only and not intended to limit the present disclosure to a particular embodiment.

Example 1

Figure 36:
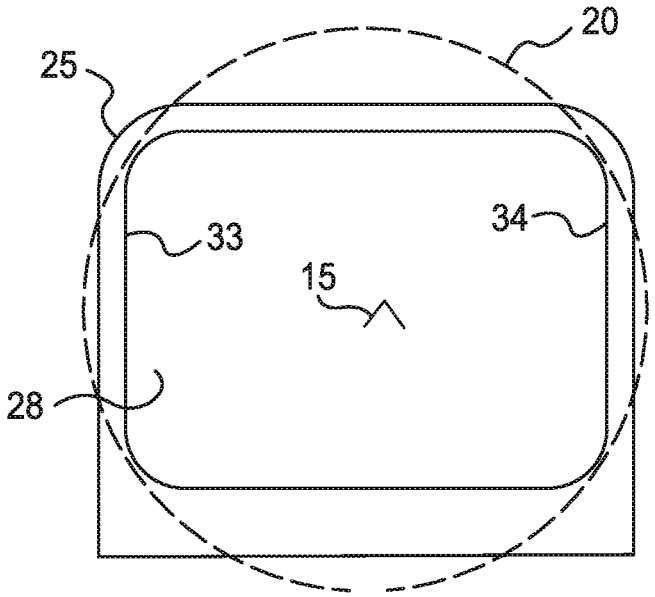
FIG. 36 is a front view of an embodiment of an optical sight illustrating part of a reticle of the optical sight in a field of view of the optical sight and part of the reticle out of the field of view of the optical sight.
Figure 37:
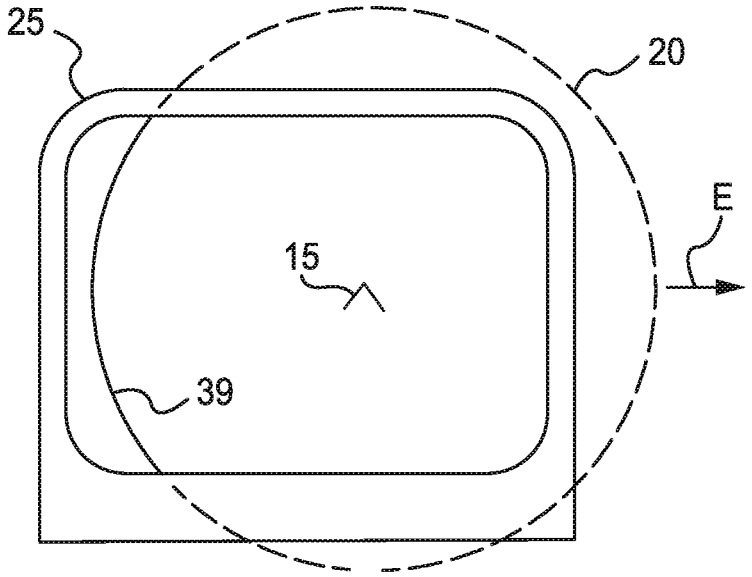
FIG. 37 is a front view of the optical sight of FIG. 36 illustrating the reticle of the optical sight in an off-center position.
Figure 38:
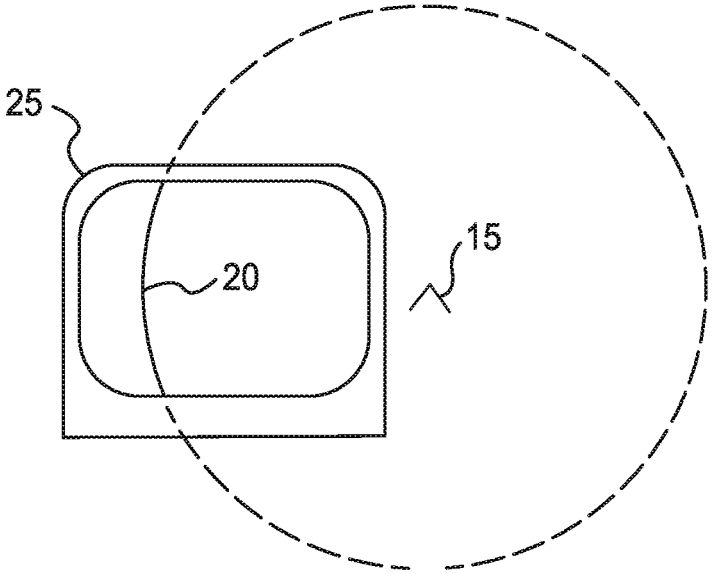
FIG. 38 is a front view of an embodiment of an optical sight of the present disclosure illustrating a reticle of the optical sight in an off-center position.
Figure 39:
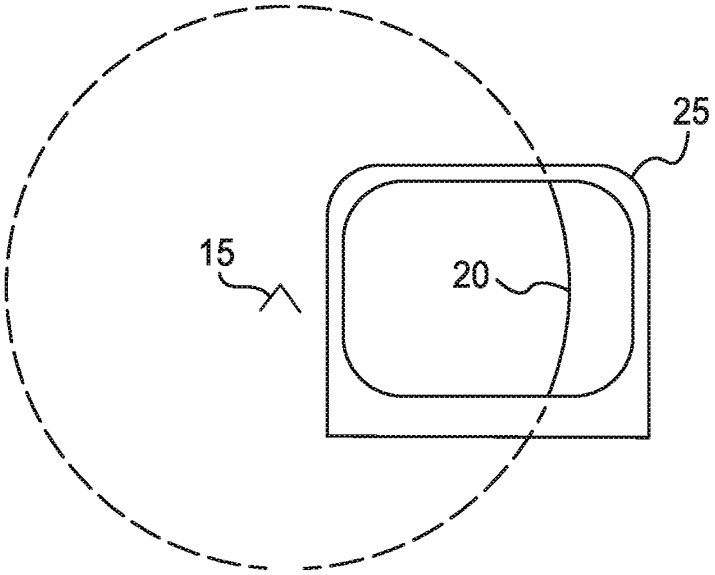
FIG. 39 is a front view of the optical sight of FIG. 38 illustrating the reticle of the optical sight in an off-center position.
Figure 40:
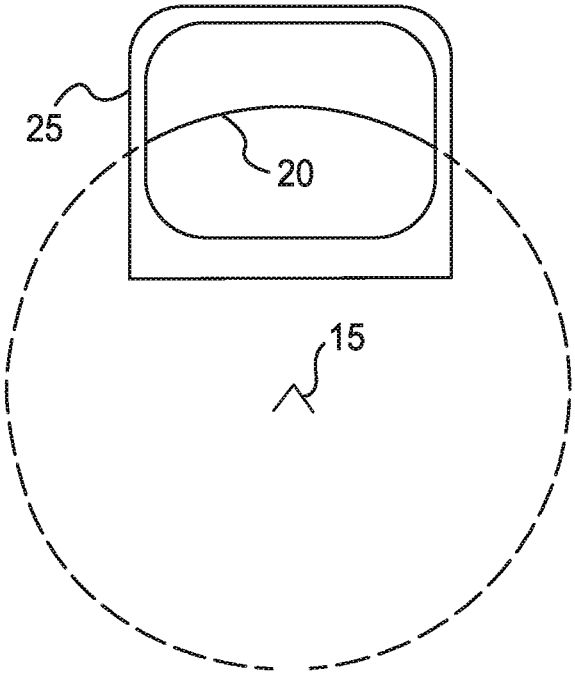
FIG. 40 is a front view of the optical sight of FIG. 38 illustrating the reticle of the optical sight in an off-center position.
Figure 41:
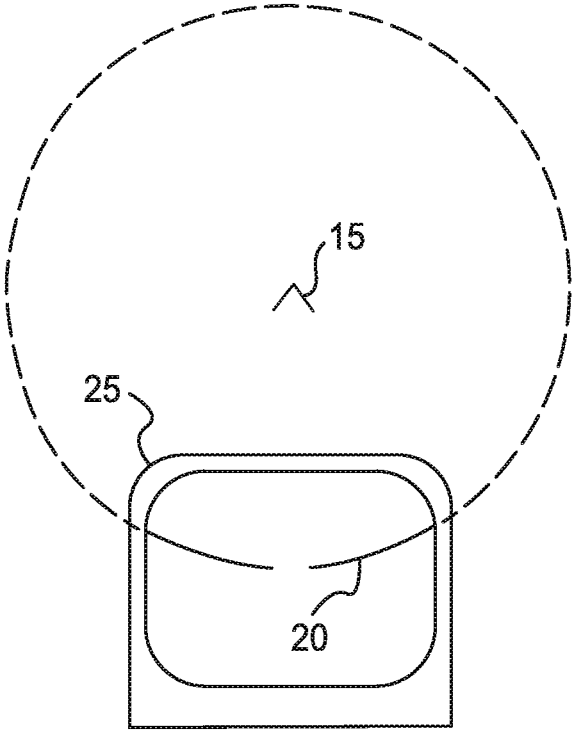
FIG. 41 is a front view of the optical sight of FIG. 38 illustrating the reticle of the optical sight in an off-center position.
Figure 42:
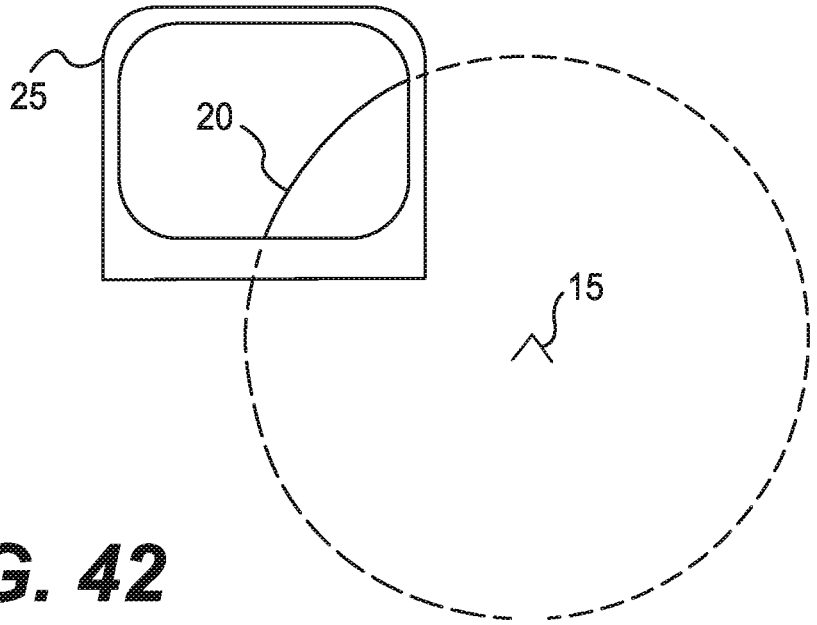
FIG. 42 is a front view of the optical sight of FIG. 38 illustrating the reticle of the optical sight in an off-center position.
Figure 43:
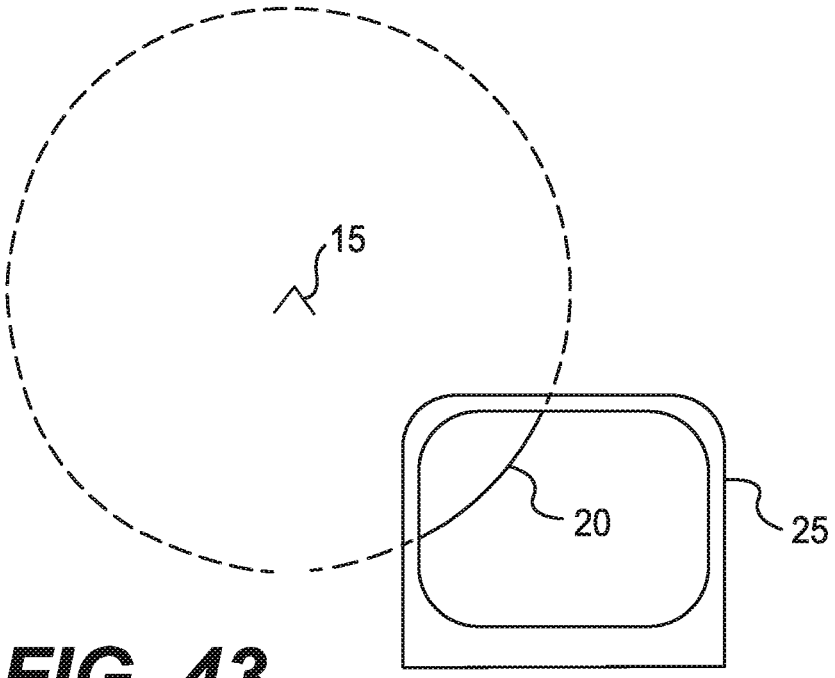
FIG. 43 is a front view of the optical sight of FIG. 38 illustrating the reticle of the optical sight in an off-center position.
Figure 44:
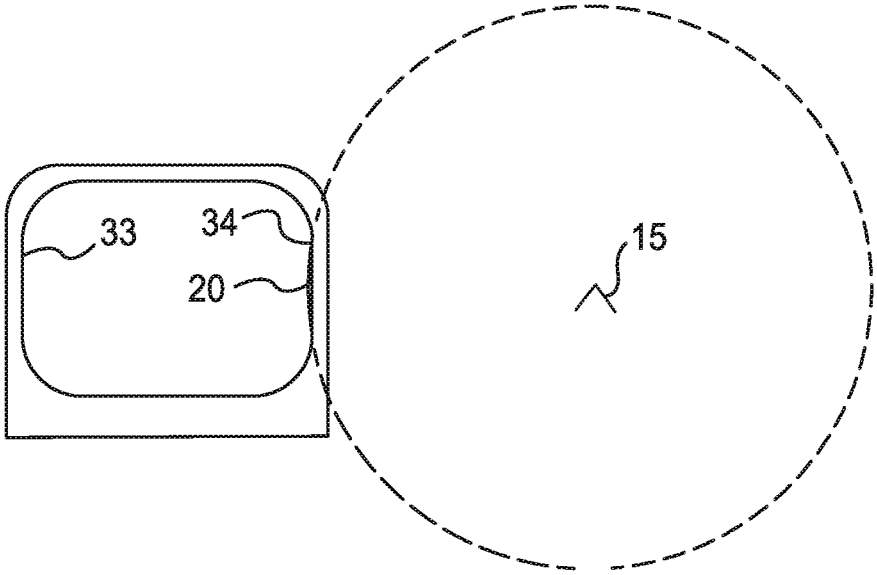
FIG. 44 is a front view of an embodiment of an optical sight of the present disclosure illustrating a reticle of the optical sight in an off-center position.
Figure 45:
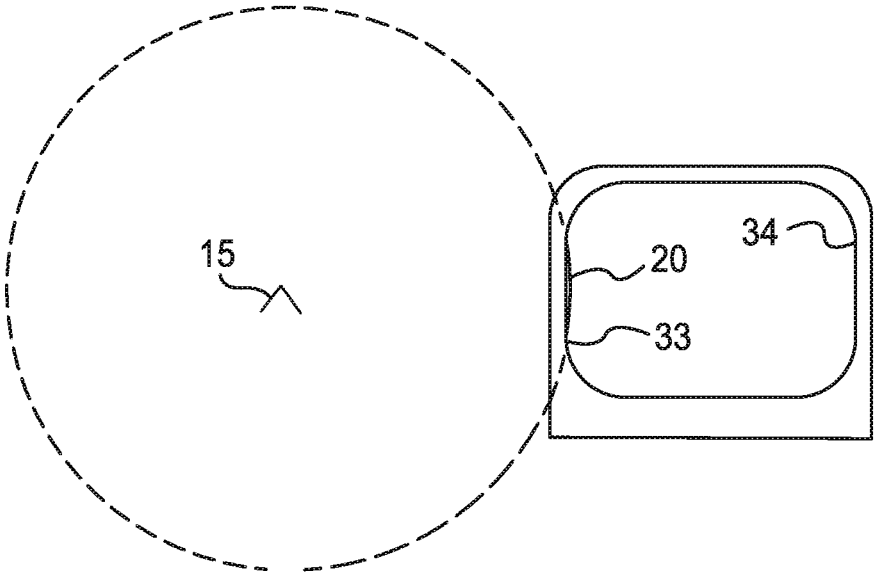
FIG. 45 is a front view of the optical sight of FIG. 44 illustrating the reticle of the optical sight in an off-center position.

In a first non-limiting example, an optical sight 25 for a pistol 5 is provided comprising a reticle 10 as shown in FIGS. 36 and 37. The optical sight 25 includes a lens 28 with a field of view of 80.0 MOA from a left side edge 33 to a right side edge 34 of the lens 28 at an operable eye distance D1 of or about 60.96 cm (24.0 inches). In this embodiment, when the center of the aiming mark 15 is positioned or located at the center of the lens 28 the center of the aiming mark 15 is (1) 40.0 MOA from either side edge 33, 34 and (2) slightly more than 40.0 MOA from the non-aiming mark 20. e.g., 40.1 MOA to 50.0 MOA from the non-aiming mark 20. As shown in FIG. 37, as the aiming mark 15 moves directionally toward the right side edge 34 (see Arrow E) a left part 39 of the non-aiming mark 20 enters the operable field of view while the aiming mark 15 is still in the operable field of view.

Example 2

In a second non-limiting example, an optical sight 25 mounted to a pistol 5 is provided comprising a reticle 10 as shown in FIGS. 38-43, each of which depicts the optical sight 25 with a misaligned sight picture including the reticle 10 in an off-center position with at least part of the non-aiming mark 20 in the operable field of view.

Example 3

In a third non-limiting example, an optical sight 25 including a reticle 10 as shown in FIGS. 8 and 9 is mounted to a pistol 5 comprising a first RCLED for producing a chevron aiming mark 15 with an upper tip 16 zeroed at 22.86 meters (25.0 yards) and a second RCLED for producing a circular type non-aiming mark 20. The optical sight 25 has the following characteristics:

Lens 28 width: 22.0 mm (0.87 inches);
Non-aiming Mark 20 inner diameter: 250.0 MOA;
Non-aiming Mark 20 line thickness: 1.0 MOA;
Aiming Mark 15 height: 10.0 MOA;
Aiming Mark 15 width at base: 13.36 MOA;
Aiming Mark 15 individual leg width: 0.8 MOA.

Figure 46:
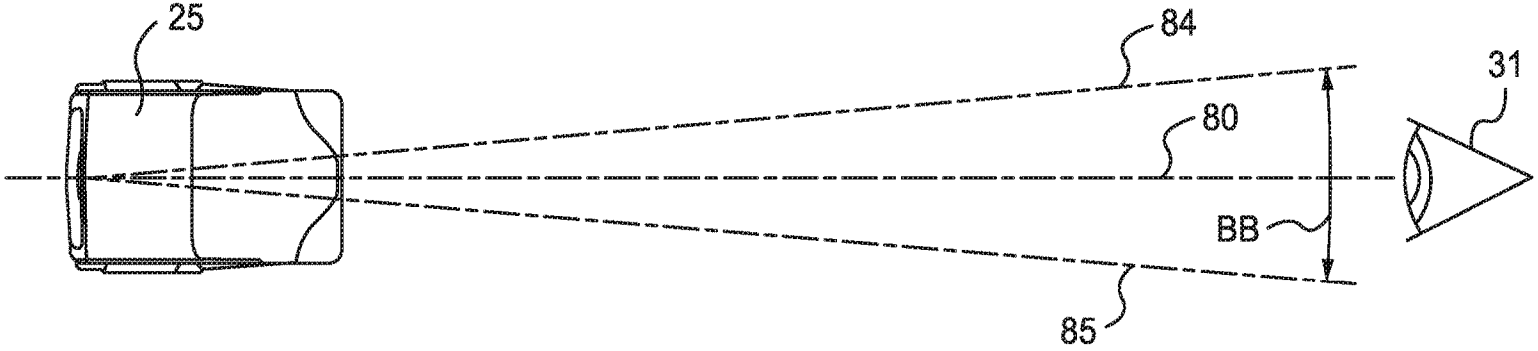
FIG. 46 is a top view of an embodiment of an optical sight of the present disclosure illustrating a maximum operable angular displacement of the optical sight.

The pistol 5 is clamped to a swivel mount tripod stand located on a level floor surface with the barrel 6 of the pistol 5 oriented in a horizontal position and the optical sight 25 positioned at an axis of the swivel mount of the stand. The stand is adjusted vertically to locate an optical axis of the lens 28 of the optical sight 25 at a height of 1.52 meters (5.0 feet) above the floor surface. A silhouette style AR500 steel plate target 99 having the following dimensions:

Width: 45.72 cm (18.0 inches);
Height: 76.2 cm (30.0 inches);

is set 10.0 meters apart from the optical sight 25 with a center point of the target 99 located at a height of 1.52 meters (5.0 feet) above the floor surface. Viewing the target 99 through the lens 28 at a distance of 60.96 cm (24.0 inches) between the lens 28 and the eye(s) 31, an individual aligns the reticle 10 of the optical sight 25 to an intended sight picture as shown in FIG. 20 establishing a zero angle 80 (FIG. 46) of the optical sight 25. From the zero angle 80 position, the swivel mount of the stand is rotated to direct the pistol 5 and optical sight 25 counterclockwise until the individual views a left side part of the non-aiming mark 20 reach the right side edge 34 of the lens 28 of the optical sight 25 establishing the maximum angular displacement from the zero angle 80 in a leftward angular direction as shown in FIG. 46 (herein referred to as the "maximum left position 84" of the optical sight 25). From the maximum left position 84 as shown in FIG. 46, the swivel mount of the stand is rotated to direct the pistol 5 and optical sight 25 clockwise until the individual views a right side part of the non-aiming mark 20 reach the left side edge 33 of the lens 28 of the optical sight 25 (a "maximum right position 85" of the optical sight 25). The measured maximum operable angular displacement from the maximum left position 84 to the maximum right position 85 is 7.32 degrees meaning that the maximum operable angular displacement of the optical sight 25 is 7.32 degrees (see BB in FIG. 46).

The optical sight 25 is removed from the pistol 5 and replaced with a prior art optical sight 3 having a lens 8 of a width of 22.0 mm similar as the optical sight 25 and a single RCLED for producing a dot reticle 7 similar as shown in FIG. 1 with an outer diameter of 14.0 MOA. The optical sight 3 is positioned at the axis of the swivel mount of the stand.

Figure 5:
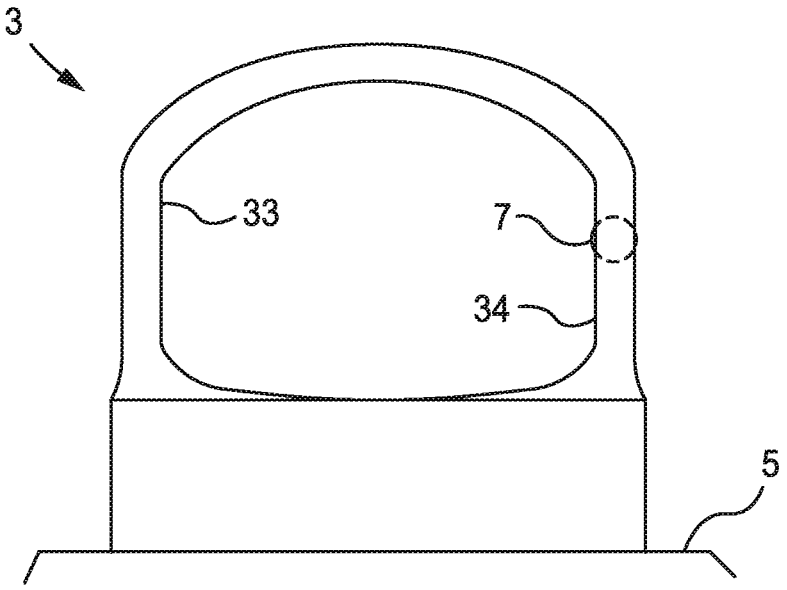
FIG. 5 (PRIOR ART)
FIG. 5 is a front view of the optical sight of FIG. 1 illustrating the optical sight in a misaligned position according to the line of sight of a shooter.
Figure 47:
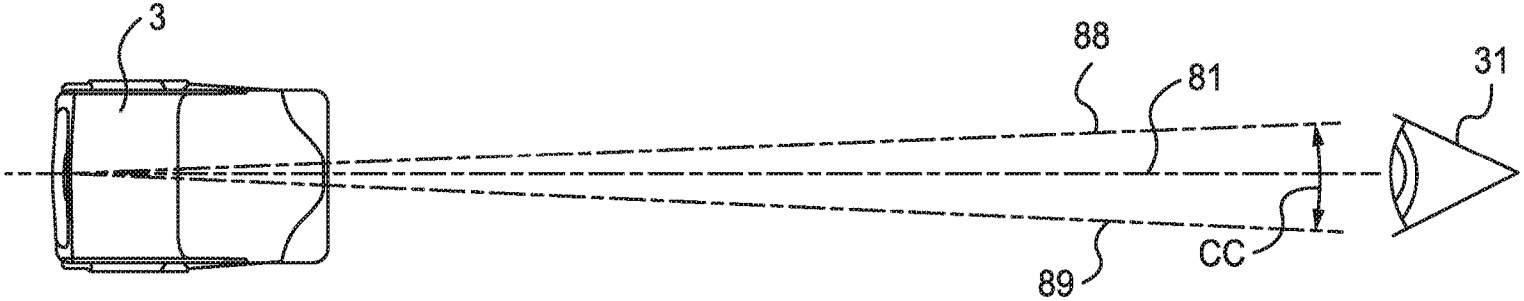
FIG. 47 (PRIOR ART)
FIG. 47 is a top view of an exemplary prior art optical sight illustrating a maximum operable angular displacement of the optical sight.

Viewing the target 99 through the lens 8 the individual aligns the dot reticle 7 of the optical sight 3 to an intended sight picture similar as shown in FIG. 2 establishing a zero angle 81 of the optical sight 3 (see FIG. 47). From the zero angle 81 position, the swivel mount of the stand is rotated to direct the pistol 5 and optical sight 3 counterclockwise until the individual views a left side part of the dot reticle 7 reach the right side edge 34 of the lens 28 of the optical sight 3 as shown in FIG. 5 (a "maximum left position 88" of the optical sight 3 as shown in FIG. 47). From the maximum left position 88 as shown in FIG. 5, the swivel mount of the stand is rotated to direct the pistol 5 and optical sight 3 clockwise until the individual views a right side part of the dot reticle 7 reach the left side edge 33 of the lens 28 of the optical sight 3 as shown in FIG. 6 (a "maximum right position 89" of the optical sight 3). The measured angular displacement from the maximum left position 88 to the maximum right position 89 is 5.00 degrees meaning that maximum operable angular displacement of the optical sight 3 is 5.00 degrees (see CC in FIG. 47), which is 2.32 degrees less than the measured maximum operable angular displacement of the optical sight 25. Thus, the maximum operable angular displacement of the optical sight 25 is 46.4 percent greater than the maximum operable angular displacement of the optical sight 3 equipped with the single RCLED operationally configured to produce a dot reticle 7 with an outer diameter of 14.0 MOA.

The single RCLED of the optical sight 3 is replaced with an alternate single RCLED operationally configured to produce a dot reticle 7 with an outer diameter of 2.0 MOA. The above operation is repeated for the optical sight 3 a second time equipped with the alternate single RCLED. The maximum operable angular displacement of the optical sight 3 is measured at 4.88 degrees, which is 2.44 degrees less than the measured maximum operable angular displacement of the optical sight 25. Thus, the maximum operable angular displacement of the optical sight 25 is 50.0 percent greater than the maximum operable angular displacement of the optical sight 3 equipped with the alternate single RCLED operationally configured to produce a dot reticle 7 with an outer diameter of 2.0 MOA.

Example 4

In a fourth non-limiting example, in an embodiment of an optical sight 25 including a reticle 10 as shown in FIGS. 8 and 9 the optical sight 25 comprises a maximum operable angular displacement greater than 5.00 degrees. In another embodiment of an optical sight 25 including a reticle 10 as shown in FIGS. 8 and 9 the optical sight 25 comprises a maximum operable angular displacement up to or about 8.00 degrees. In another embodiment of an optical sight 25 including a reticle 10 as shown in FIGS. 8 and 9 the optical sight 25 comprises a maximum operable angular displacement up to or about 10.00 degrees.

Example 5

In a fifth non-limiting example, an optical sight 25 comprising a reticle 10 as shown in any of FIGS. 8-12, 14-18, and 23-35 may be described as provided in the following four paragraphs.

An optical sight for a firearm comprising a reticle including one or more aiming marks and one or more non-aiming marks; wherein at an operable eye distance of the optical sight, when the one or more aiming marks are in a field of view of the optical sight the one or more non-aiming marks are outside the field of view of the optical sight.

An optical sight for a firearm comprising a reticle including one or more aiming marks and one or more non-aiming marks; wherein at an intended sight picture of the optical sight the one or more aiming marks are in a field of view of the optical sight and the one or more non-aiming marks are outside the field of view of the optical sight.

An optical sight for a firearm comprising a reticle projected onto a lens of the optical sight, the reticle comprising one or more aiming marks and one or more non-aiming marks, wherein the one or more aiming marks include a dimension of a first angular measurement and the one or more non-aiming marks include a dimension of a second angular measurement; wherein an operable field of view of the optical sight provides a third angular measurement less than the second angular measurement.

A method for a firearm operator to acquire an intended sight picture for firing a firearm at an intended target, comprising (1) providing an optical sight attached to a firearm, the optical sight comprising a reticle including one or more aiming marks and one or more non-aiming marks, wherein at an operable eye distance of the optical sight, when the one or more aiming marks are in a field of view of the optical sight the one or more non-aiming marks are outside the field of view of the optical sight; and (2) the firearm operator presenting the firearm at the intended target using the reticle to acquire an intended sight picture.

Although the present disclosure is described above in terms of various exemplary embodiments and implementations, it should be understood that the various features and functionality described in one or more of the individual embodiments are not limited in their applicability to the particular embodiment with which they are described, but instead might be applied, alone or in various combinations, to one or more other embodiments whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more," or the like.

Persons of ordinary skill in the art will recognize that many modifications may be made to the present disclosure without departing from the spirit and scope of the disclosure. The embodiment(s) described herein are meant to be illustrative only and should not be taken as limiting the disclosure, which is defined in the claims.

I claim:

1. An optical sight for a firearm, comprising:

a partially reflective optical element;

electronic components including:

a power source; and one or more resonant cavity light-emitting diodes for emitting light towards the partially reflective optical element;

a reflective image projected onto the partially reflective optical element by the one or more resonant cavity light-emitting diodes, the reflective image including a reticle pattern according to a configuration of the one or more resonant cavity light-emitting diodes, the reticle pattern comprising one or more aiming marks and one or more non-aiming marks;

wherein the one or more aiming marks are defined by an outer width of a first angular measurement;

wherein the one or more non-aiming marks are defined by an inner width of a second angular measurement greater than the first angular measurement;

wherein at an operable eye distance the optical sight includes a field of view of a third angular measurement according to a largest dimension of the partially reflective optical element; and wherein at an intended sight picture of the optical sight the third angular measurement is less than the second angular measurement, the one or more aiming marks are in the field of view and the one or more non-aiming marks are outside the field of view.

2. The optical sight of claim 1 wherein the second angular measurement is twice the third angular measurement.

3. The optical sight of claim 1 wherein the optical sight comprises a maximum operable angular displacement greater than 7.00 degrees.

4. The optical sight of claim 1 wherein the one or more non-aiming marks include an open circle having a line thickness of 1.0 MOA.

5. The optical sight of claim 1 wherein the partially reflective optical element includes a width of 22.0 mm and the third angular measurement is 80.0 MOA.

6. The optical sight of claim 5 wherein the second angular measurement is twice the third angular measurement.

* * * * *